US012422147B2

(12) United States Patent
Kim et al.

(10) Patent No.: US 12,422,147 B2
(45) Date of Patent: Sep. 23, 2025

(54) RANGE HOOD

(71) Applicant: SAMSUNG ELECTRONICS CO., LTD., Suwon-si (KR)

(72) Inventors: Seokang Kim, Suwon-si (KR); Woojoo Kim, Suwon-si (KR); Inho Choi, Suwon-si (KR); Byounghoon Moon, Suwon-si (KR); Heejin Yoon, Suwon-si (KR); Chulwoo Lee, Suwon-si (KR); Jungseung Lim, Suwon-si (KR); Sunwoo Han, Suwon-si (KR)

(73) Assignee: SAMSUNG ELECTRONICS CO., LTD., Gyeonggi-Do (KR)

( * ) Notice: Subject to any disclaimer, the term of this patent is extended or adjusted under 35 U.S.C. 154(b) by 112 days.

(21) Appl. No.: 18/315,087

(22) Filed: May 10, 2023

(65) Prior Publication Data

US 2023/0417423 A1 Dec. 28, 2023

Related U.S. Application Data

(63) Continuation of application No. PCT/KR2023/004693, filed on Apr. 7, 2023.

(30) Foreign Application Priority Data

Jun. 22, 2022 (KR) ..... 10-2022-0076459
Sep. 8, 2022 (KR) ..... 10-2022-0114543

(51) Int. Cl.
*F24C 15/20* (2006.01)

(52) U.S. Cl.
CPC ..... *F24C 15/2064* (2013.01)

(58) Field of Classification Search
None
See application file for complete search history.

(56) References Cited

U.S. PATENT DOCUMENTS 5,868,486 A * 2/1999 Takano ..... G02B 6/009 362/23.15
6,450,662 B1 * 9/2002 Hutchison ..... F21S 8/00 362/558
D487,505 S * 3/2004 Grobleben ..... D23/371
D490,887 S * 6/2004 Segers ..... D23/372
(Continued)

FOREIGN PATENT DOCUMENTS

CN 202166108 U 3/2012
CN 204083984 U 1/2015
(Continued)

OTHER PUBLICATIONS

PCT International Search Report for PCT/KR2023/004693 dated Jul. 27, 2023.
(Continued)

*Primary Examiner* — Joseph A Dillon, Jr.
(74) *Attorney, Agent, or Firm* — CANTOR COLBURN LLP

(57) ABSTRACT

A range hood comprises a duct, and a main body coupled to the duct and facing the cooktop, wherein the main body includes a light source device including an illumination light source capable of emitting illumination light in a first direction toward the cooktop from the main body, and a guide light source capable of emitting guide light in a second direction from the main body.

19 Claims, 22 Drawing Sheets

(56) References Cited

U.S. PATENT DOCUMENTS

| | | | | |
|---|---|---|---|---|
| 6,939,024 | B2 * | 9/2005 | Keller | F21V 23/04 362/234 |
| 7,287,896 | B2 * | 10/2007 | Okamoto | F21S 43/14 362/248 |
| D566,821 | S * | 4/2008 | Wilsdorf | D23/372 |
| D610,668 | S * | 2/2010 | Grey | D23/372 |
| D621,023 | S * | 8/2010 | Funnell | D23/372 |
| 8,827,531 | B2 * | 9/2014 | Richardson | F21V 7/04 362/555 |
| 8,997,732 | B2 * | 4/2015 | Oagley | F24C 15/2064 362/264 |
| 9,441,810 | B2 * | 9/2016 | Kennedy | F21V 7/041 |
| 10,539,330 | B2 * | 1/2020 | Buriola | H05B 45/10 |
| 10,796,590 | B2 * | 10/2020 | Nolan | F24C 15/2064 |
| D939,073 | S * | 12/2021 | Oh | D23/372 |
| D944,384 | S * | 2/2022 | Yuan | D23/372 |
| 11,639,796 | B2 * | 5/2023 | Cowan | F24C 3/126 126/39 BA |
| 11,747,022 | B2 * | 9/2023 | Cowan | F23N 1/002 431/69 |
| 11,788,729 | B2 * | 10/2023 | Cowan | F24C 7/086 126/39 BA |
| D1,025,336 | S * | 4/2024 | Choi | D23/372 |
| 12,044,406 | B2 * | 7/2024 | Neal | F23N 1/002 |
| D1,049,352 | S * | 10/2024 | Park | D23/372 |
| 12,158,273 | B2 * | 12/2024 | Mueller | H05B 1/0266 |
| 2004/0221839 | A1 * | 11/2004 | Plankl | F24C 15/2064 126/299 D |
| 2012/0281432 | A1 * | 11/2012 | Parker | F21V 7/00 362/609 |
| 2013/0170206 | A1 * | 7/2013 | Isogai | F21V 5/041 362/296.07 |
| 2014/0001173 | A1 | 1/2014 | Holzgreve | |
| 2015/0109778 | A1 * | 4/2015 | Yokotani | F21K 9/232 362/235 |
| 2023/0003392 | A1 * | 1/2023 | Lee | H05B 6/642 |
| 2023/0007741 | A1 * | 1/2023 | Lee | F24C 15/007 |

FOREIGN PATENT DOCUMENTS

| | | | |
|---|---|---|---|
| CN | 104101007 | A | 8/2016 |
| CN | 112539429 | A | 3/2021 |
| CN | 216010945 | U | 3/2022 |
| DE | 102009044504 | B3 | 6/2011 |
| EP | 1239228 | A2 | 9/2002 |
| EP | 3059506 | A1 | 8/2016 |
| EP | 3745032 | A1 | 12/2020 |
| JP | 2019056507 | A | 4/2019 |
| KR | 1020090082734 | A | 7/2009 |
| KR | 1020090131221 | A | 12/2009 |
| KR | 100937002 | B1 | 1/2010 |
| KR | 1020100083941 | A | 7/2010 |
| KR | 1020110019071 | A | 2/2011 |
| KR | 1020120128205 | A | 11/2012 |
| KR | 101783173 | B1 | 9/2017 |
| KR | 10-2066262 | B1 | 1/2020 |
| KR | 20200041414 | A | 4/2020 |
| KR | 102124387 | B1 | 6/2020 |
| KR | 102170970 | B1 | 10/2020 |
| KR | 1020210018157 | A | 2/2021 |
| KR | 20210110986 | A | 9/2021 |
| WO | 2010142542 | A | 12/2010 |

OTHER PUBLICATIONS

European Office Action for European Patent Application No. 23827339.5 dated Apr. 29, 2025.

* cited by examiner

RANGE HOOD

CROSS-REFERENCE TO RELATED APPLICATION

This application is a continuation application of International Application No. PCT/KR2023/004693 designating the United States, filed on Apr. 7, 2023, in the Korean Intellectual Property Receiving Office and claiming priority to Korean Patent Application No. 10-2022-0076459 filed on Jun. 22, 2022 and Korean Patent Application No. 10-2022-0114543 filed on Sep. 8, 2022 in the Korean Intellectual Property Office, the disclosures of which are incorporated by reference herein in their entireties.

BACKGROUND

1. Field

The disclosure relates to a range hood, and more particularly, to a light source module included in a range hood.

2. Description of the Related Art

A range hood is positioned above an apparatus for heating food and draws-in pollutants, such as a combustion gas, fine dust, oil mist, etc. which are generated from food being heated on the apparatus.

The range hood faces a cooktop of a cooking appliance. The range hood draws in pollutants generated from a cooking material being cooked on the cooktop and discharges the pollutants to the outside.

SUMMARY

To facilitate cooking on a cooktop of a cooking appliance, light is irradiated onto the cooktop. However, the cooktop may be shadowed by the presence of a range hood or a ventilation hood which is above the cooktop.

Therefore, it is an aspect of the disclosure to provide a range hood configured to irradiate light onto a cooktop.

It is an aspect of the disclosure to provide a range hood configured to irradiate light to an outer appearance thereof while irradiating light onto a cooktop.

It is an aspect of the disclosure to provide a range hood capable of irradiating light to an outer appearance thereof, independently from light that is irradiated onto a cooktop.

It is an aspect of the disclosure to provide a range hood in which a plurality of light sources are positioned to irradiate light in different directions within a limited space.

Technical problems to be solved by the present specification are not limited to the above-mentioned technical problem, and other technical problems not mentioned above can be clearly understood by one skilled in the art from the following description.

In accordance with an embodiment of the disclosure, a range hood comprises, a duct, and a main body coupled to the duct and facing a cooktop, wherein the main body includes a light source device including an illumination light source capable of emitting illumination light in a first direction toward the cooktop from the main body, and a guide light source capable of emitting guide light in a second direction from the main body.

The emission of the guide light by the guide light source independent from emission of the illumination light by the illumination light source.

The second direction may intersect the first direction.

The guide light source may emit the guide light having a color that is different from a color of the illumination light emitted from the illumination light source.

The light source device may further include a transparent member spaced in the first direction from the illumination light source and configured to diffuse the illumination light.

The light source device may further include a light diffuser positioned between the transparent member and the illumination light source and configured to diffuse the illumination light, and the illumination light may pass through the light diffuser and the transparent member and be emitted toward the cooktop.

The light diffuser may be detachably supported by the transparent member.

The light source device may include a bracket supporting unit positioned on the transparent member and positioned in the second direction from the light diffuser, and a light source supporting unit positioned on the transparent member and positioned in an opposite direction of the second direction from the light diffuser, wherein the light diffuser may include a diffuser plate guide portion bent in an opposite direction of the first direction to be in contact with the bracket supporting unit or the light source supporting unit.

The guide light source may emit the guide light in the first direction, and the light source device may further include a guide diffuser configured to reflect the guide light in the second direction.

The guide diffuser may face the transparent member such that the guide light is emitted by passing through the transparent member.

At least one portion of the guide diffuser may be spaced from the guide light source to define a guide diffusing space between the guide diffuser and the guide light source.

The light source device may further include a light source supporting unit positioned in the second direction from the guide light source such that the guide diffusing space is defined between the light source supporting unit and the guide diffuser, and the light source supporting unit may include an indirect reflection surface toward the guide diffusing space to reflect the guide light.

The guide diffuser may include a prism portion configured such that the guide light is transmitted through inside of the prism portion and reflected from an inclined surface inclined with respect to the first direction and the second direction.

The range hood may further include a guide light source substrate configured to support the guide light source, wherein the guide diffuser may include a substrate supporting portion configured to support the guide light source substrate.

The substrate supporting portion may be positioned to a side of the guide light source, and the guide diffuser may further include a connecting portion extending from the substrate supporting portion to the prism portion to guide the guide light emitted from the guide light source to the prism portion.

In accordance with an embodiment of the disclosure, a range hood comprises a hood body which faces a cooktop in a first direction, the cooktop including a front side from which the hood body is viewed, a light source device within the hood body, the light source device emitting an illumination light in the first direction, to the cooktop, and emitting a guide light in a second direction, to the front side of the cooktop and an exhaust duct which is connected to the hood body and from which air exits the ventilation hood.

The light source device comprises a guide light source which emits the guide light in the first direction, an illumination light source which emits the illumination light in the first direction, and a light guide member which receives the guide light in the first direction from the guide light source and emits the guide light in the second direction, to the front side of the cooktop.

The light source device comprises an illumination light source which emits the illumination light in the first direction, a transparent member facing the illumination light source and through which the illumination light passes in the first direction, to the cooktop, the transparent member having a light incident end surface, and a guide light source which emits the guide light in the second direction and is spaced apart from the light incident surface of the transparent member in a direction opposite to the second direction.

The light source device comprises a guide light source which emits the guide light in the first direction, an illumination light source which emits the illumination light in a direction inclined with respect to the first direction, and a light guide member which receives the guide light and the illumination light, and emits the guide light in the second direction to the front side of the cooktop and emits the illumination light in the first direction to the cooktop, respectively.

The hood body comprises a housing plate facing the cooktop in the first direction and having an outer edge, and a frame portion which protrudes in the first direction from the housing plate and extends along the outer edge of the housing plate, the frame portion being spaced apart from the outer edge of the housing plate, and the light source device is connected to the frame portion and extends from the frame portion to the outer edge of the housing plate, at the front side of the cooktop.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
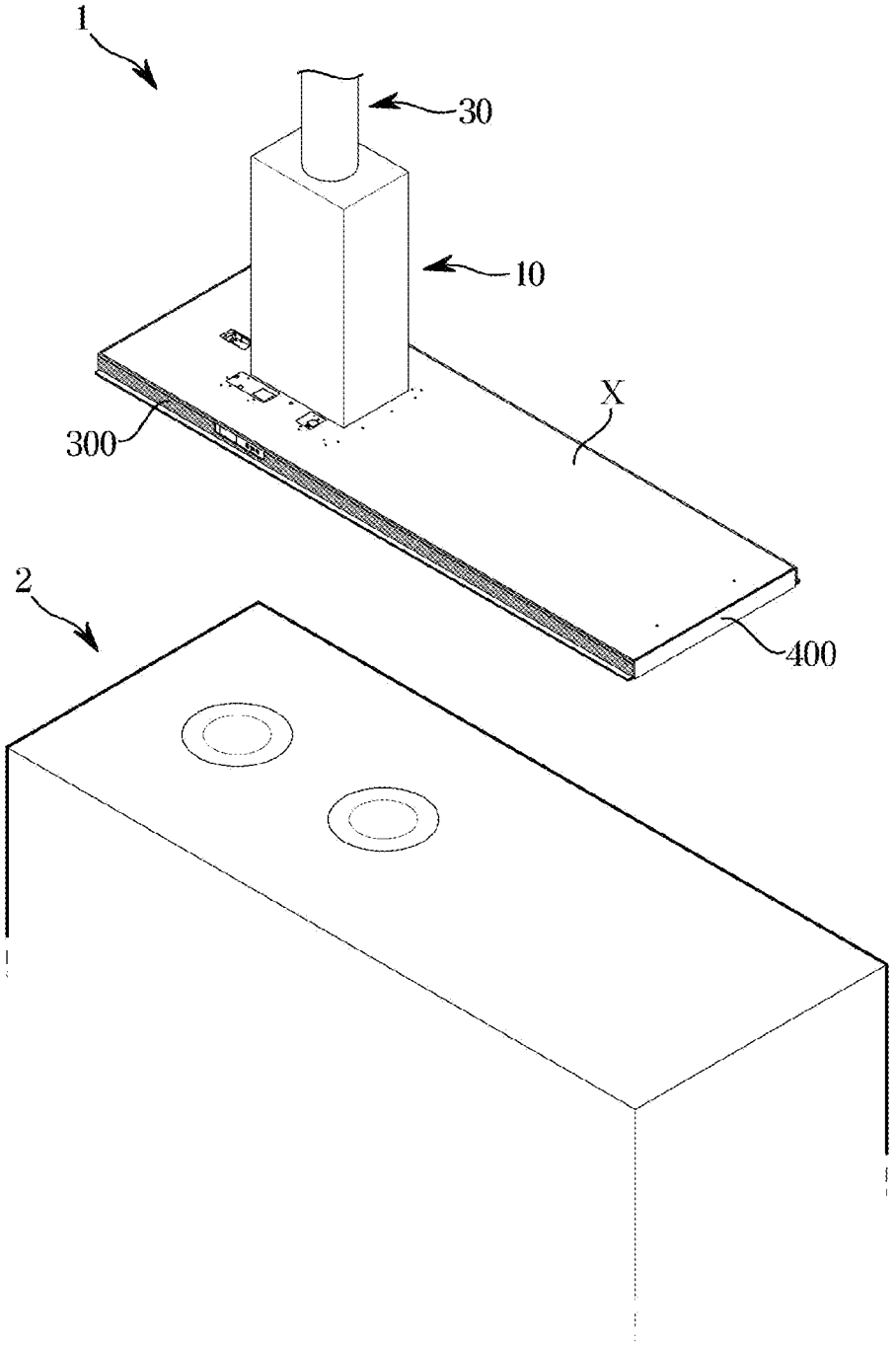
FIG. 1 is a perspective view showing a range hood and a cooktop according to an embodiment of the disclosure.

Various embodiments of the present disclosure and terms used therein are not intended to limit the technical features described in the present disclosure to particular embodiments, and it should be construed as including various modifications, equivalents, or alternatives of a corresponding embodiment.

With regard to description of drawings, similar reference numerals may be used for similar or related components.

A singular form of a noun corresponding to an item may include one item or a plurality of the items unless context clearly indicates otherwise. For example, a reference number labeling a singular form of an element within the figures may be used to reference a plurality of the singular element within the text of the disclosure. As used herein, "a", "an," "the," and "at least one" do not denote a limitation of quantity, and are intended to include both the singular and plural, unless the context clearly indicates otherwise. For example, "an element" has the same meaning as "at least one element," unless the context clearly indicates otherwise.

As used herein, each of the expressions "A or B," "at least one of A and B," "at least one of A or B," "A, B, or C," "at least one of A, B, and C," and "at least one of A, B, or C," may include one or all possible combinations of the items listed together with a corresponding expression among the expressions.

The term "and/or" includes any and all combinations of one or more of a plurality of associated listed items.

It will be understood that the terms "first", "second", etc., may be used only to distinguish one component from another, not intended to limit the corresponding component in other aspects (e.g., importance or order).

It is said that one (e.g., first) component is "coupled" or "connected" to another (e.g., second) component, with or without the terms "functionally" or "communicatively". When referenced, it means that one component can be connected to the other component directly (e.g., by wire), wirelessly, or through a third component.

It will be understood that when the terms "includes," "comprises," "including," and/or "comprising," when used in this specification, specify the presence of stated features, figures, steps, operations, components, members, or combinations thereof, but do not preclude the presence or addition of one or more other features, figures, steps, operations, components, members, or combinations thereof.

An expression that one component is "connected", "coupled", "supported", or "in contact" with another component includes a case in which the components are directly "connected", "coupled", "supported", or "in contact" with each other and a case in which the components are indirectly "connected", "coupled", "supported", or "in contact" with each other through a third component. In contrast, an expression of one component is "directly connected", "directly coupled", "directly supported", or "directly in contact" with another component defines a case in which no third component is present between the components.

It will also be understood that when one component is referred to as being "on" or "over" another component, it can be directly on the other component or intervening components may also be present.

In the following description, the terms "up-down direction", "lower portion", "front-rear direction", etc. are defined based on the drawings, and the shapes and positions of the corresponding components are not limited by the terms.

"About" or "approximately" as used herein is inclusive of the stated value and means within an acceptable range of deviation for the particular value as determined by one of ordinary skill in the art, considering the measurement in question and the error associated with measurement of the particular quantity (i.e., the limitations of the measurement system). For example, "about" can mean within one or more standard deviations, or within ±30%, 20%, 10% or 5% of the stated value.

Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

Embodiments are described herein with reference to cross section illustrations that are schematic illustrations of idealized embodiments. As such, variations from the shapes of the illustrations as a result, for example, of manufacturing techniques and/or tolerances, are to be expected. Thus, embodiments described herein should not be construed as limited to the particular shapes of regions as illustrated herein but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the present claims.

More specifically, as shown in FIG. 1, a direction in which a range hood 1 faces a cooktop 2 may be defined as a down direction, and an up direction, left and right directions, and front and rear directions may be defined with respect to the down direction.

Hereinafter, an embodiment of the disclosure will be described in detail with reference to the accompanying drawings.

FIG. 1 is a perspective view showing the range hood 1 as a ventilation hood and the cooktop 2 as representing a cooking (or heating) appliance according to an embodiment of the disclosure.

Referring to FIG. 1, the range hood 1 according to an embodiment of the disclosure and the cooktop 2 will be described.

The range hood 1 according to an embodiment of the disclosure may be positioned indoors, such as in an enclosed area. For example, the range hood 1 may be positioned in a kitchen.

The range hood 1 may suck or draw in a combustion gas, smoke, food smell, etc. generated from the cooktop 2, and discharge the combustion gas, smoke, food smell, etc. to the outside. As used herein, outside may mean outside of the enclosed area, outside of a room, etc.

The cooktop 2 may be a heating or cooking apparatus such as an oven, a gas stove, an induction range, or the like. Particularly, the cooktop 2 may include a cooktop unit by which food is cooked, such as by being placed on the cooktop 2 and cooked.

The range hood 1 may be one of various types. The range hood 1 may be a standalone type hood into which a main body X is integrated. The standalone type hood may need not to be positioned in a surrounding housing or case, such as a piece of furniture (not shown). The range hood 1 may be a chimney type hood. The chimney type hood may have a shape having a wide entrance through which smoke is drawn, like a chimney, and being narrowed toward an up direction. The chimney type hood may be not positioned inside furniture.

The range hood 1 may be an island hood. The island hood may be a hood installed above an island table. The island table may be a table separated from a sink or an existing cooking table, and the island table may be used in a small kitchen or as an auxiliary cooking table.

The range hood 1 may be a built-in hood. The built-in hood may be a hood built in a space or surrounding structure, like a built-in closet. The range hood 1 may be a secret hood. The secret hood may have a different shape from a normal hood, as seen from the outside.

In an embodiment of the disclosure, an example in which the range hood 1 is an island hood will be described, although not limited thereto. However, the range hood 1 may be one of various kinds of hoods.

An example in which the range hood 1 is installed indoor has been described, however, a method of installing the range hood 1 is not limited to this. The range hood 1 may be installed by various methods according to a size or characteristics of an installation place, an installation purpose, etc.

Also, the range hood 1 is not limited to an embodiment of the disclosure, and may be coupled to a cooking device unit such as an over-the-range (OTR) hood.

The range hood 1 may face the cooktop 2. The range hood 1 may be positioned above the cooktop 2. Accordingly, the range hood 1 may suck a combustion gas, smoke, or food smell generated from the cooktop 2 in the up direction and discharge the combustion gas, smoke, or food smell to the outside.

The range hood 1 may include the main body X and a hood body. The main body X may extend along and face the cooktop 2.

Pollutants generated from a cooking material being cooked on the cooktop 2 may enter into the range hood 1 at the main body X, pass through the main body X and be discharged to the outside. The main body X may be in communication with outside of the range hood 1, such as being exposed to the cooktop 2.

The main body X may be positioned above the cooktop 2. The main body X may be spaced apart from the cooktop 2.

The main body X may be substantially in a shape of a rectangle. That is, a planar shape may be a rectangle, without being limited thereto.

The main body X may be coupled to a duct 10.

The range hood 1 may include the duct 10. The duct 10 may be connected with the main body X.

The duct 10 may be coupled to the main body X. The duct 10 may be connected with an upper side of the main body X.

The duct 10 may accommodate an exhaust fan 20.

The duct 10 may be positioned on the main body X. Since a cooking material (e.g., a material which is heated or cooked) is put on the cooktop 2, pollutants generated from the cooking material may be vaporized or change to tiny droplets of liquid and then move upward. The duct 10 may be positioned above the cooktop 2 to guide pollutants in the upward direction towards the range hood 1.

The duct 10 may communicate with the main body X. The duct 10 may guide a movement of pollutants, such as in a flow direction through the range hood 1. The main body X may be in communication with the duct 10, such as in fluid communication, airflow communication, etc.

The entire area of the cooktop 2 may be not used to cook cooking materials. That is, a portion of the total planar area of the cooktop 2 may be used to cook cooking materials and define a cooking planar area, except for a remaining planar area. On the remaining area of the cooktop 2, cooking actions such as cutting may be performed by a user of the cooking appliance.

The duct 10 may be positioned to correspond to the cooking planar area for cooking the cooking materials by the cooktop 2. In a planar direction along the main body X or along the cooktop 2, the duct 10 may be positioned on the upper side of the main body X to correspond to a planar area at which a cooking material may be positioned on the cooktop 2.

The duct 10 may be substantially in a shape of a rectangle, although not limited thereto.

The duct 10 may be made of or include a metal material, although not limited thereto.

The duct 10 may be formed or provided by a press process, although not limited thereto.

The range hood 1 may include an exhaust pipe 30. The exhaust pipe 30 may communicate with the outside. The duct 10 together with the exhaust fan 20 and the exhaust pipe 30 may otherwise be referred to as an exhaust duct.

The exhaust pipe 30 may be coupled to the duct 10. The exhaust pipe 30 may be coupled to an upper side of the duct 10. Since pollutants generated from a cooking material being cooked on the cooktop 2 are heated, the pollutants may move upward due to airflow in a direction toward the range hood 1 from the cooktop 2. Accordingly, the pollutants may move toward the exhaust pipe 30 because the duct 10 is positioned below the exhaust pipe 30.

The exhaust pipe 30 may communicate with the duct 10. Accordingly, pollutants moving along the duct 10 may pass through the duct 10 and then move to the exhaust pipe 30. Since the exhaust pipe 30 communicates with the outside, the pollutants passed through the duct 10 may move to the outside.

The exhaust pipe 30 may guide a movement of pollutants.

The exhaust pipe 30 may be in a shape of a cylinder, although not limited thereto.

A cross section of the exhaust pipe 30 being in contact with the duct 10 may be smaller than a cross section of the duct 10 being in contact with the exhaust pipe 30.

The exhaust pipe 30 may be flexible. Accordingly, the exhaust pipe 30 may be connected with an opening (not shown) that opens to or is in communication with the outside, regardless of a location of the duct 10.

The exhaust pipe 30 may include a metal material, although not limited thereto.

The exhaust pipe 30 may be formed by a press process, although not limited thereto.

Figure 4:
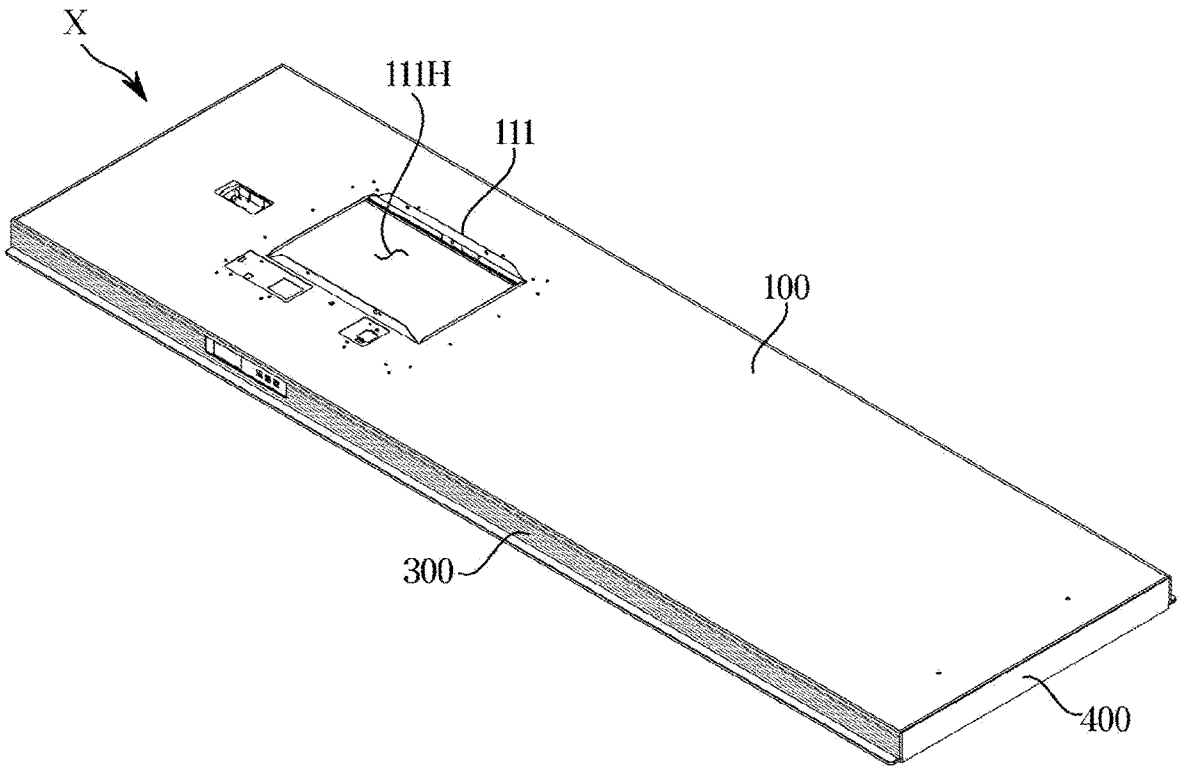
FIG. 4 is a perspective view of a main body of the range hood shown in FIG. 3.

The main body X may include a housing 100 (see FIG. 4). The housing 100 may define an outer appearance of the main body X. In an embodiment, a ventilation hood (e.g., the range hood) may include a hood body (e.g., the main body X together with the housing 100) which faces a cooktop 2 in a first direction D2, the cooktop including a front side from which the hood body is viewed, a light source device Y within the hood body, the light source device Y emitting an illumination light L1 in the first direction D1, to the cooktop 2, and emitting a guide light L2 in a second direction D2, to the front side of the cooktop 2, and an exhaust duct (e.g., the duct 10 together with the exhaust pipe 30) which is connected to the hood body and from which air exits the ventilation hood.

The housing 100 may define an upper outer appearance of the main body X.

The housing 100 may communicate with (e.g., be in communication with) the duct 10. The housing 100 may guide air including pollutants from below and move the air to the duct 10.

The housing 100 may be substantially in a shape of a rectangle, such as having a rectangular parallelepiped shape.

The main body X may include a light source device Y. The light source device Y may be a component capable of irradiating light.

The light source device Y may be coupled to the housing 100. The light source device Y may be coupled to a front or rear portion of the housing 100.

Figure 2:
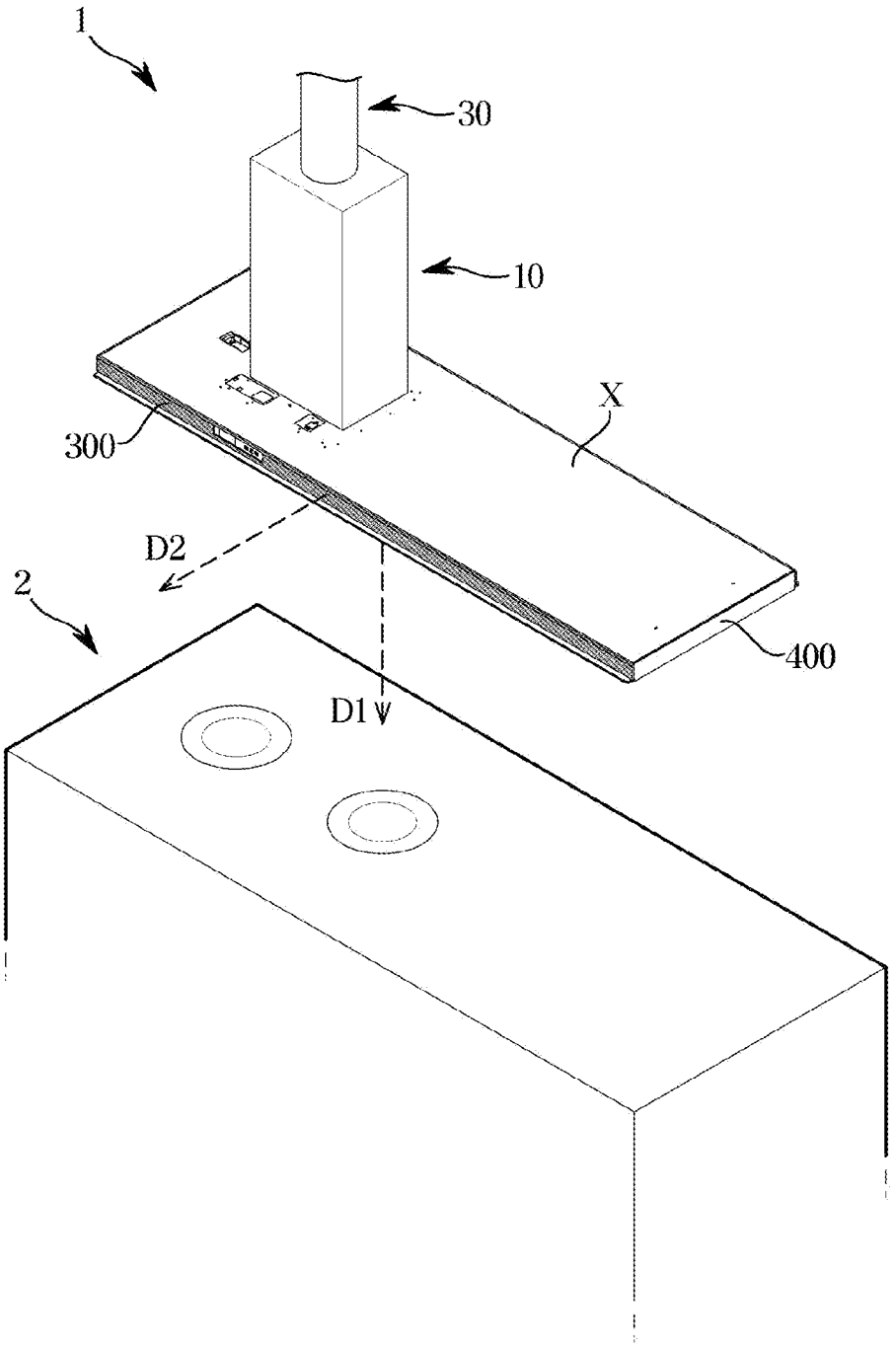
FIG. 2 is a perspective view showing a state in which the range hood shown in FIG. 1 irradiates light.

The light source device Y may define a front or rear outer appearance of the main body X. Referring to FIG. 2, for example, a front direction may correspond to a second direction D2. A rear direction may correspond to a direction which is opposite to the second direction D2.

The light source device Y (see FIG. 6) may include a light source module 300 that is detachable from the light source device Y for a service, and a light source unit 200 coupled to the housing 100. That is, the light source module 300 is removably disposed with the light source device Y, to be attachable to and removable from the light source device Y. The light source unit 200 may define a light source which generates and emits light of the light source device Y.

The main body X may include a rail device. A rail module 400 may be a component capable of guiding a movement of the light source module 300.

The rail module 400 may be coupled to the housing 100. The rail module 400 may be coupled to a right or left side of the housing 100. The right or left side may be a third direction which crosses each of the first direction D1 and the second direction D2 shown in FIG. 2. Here, the main body X may have a major dimension along the third direction, such as in a plane defined by the third direction and the second direction D2 crossing each other.

The rail module 400 may define a left or right outer appearance of the main body X.

FIG. 2 is a perspective view showing a state in which the range hood 1 shown in FIG. 1 irradiates light.

Referring to FIG. 2, a light-emitting direction of the light source device Y according to an embodiment of the disclosure will be described.

The light source device Y may irradiate light in a first direction D1 toward the cooktop 2. By irradiating light in the first direction D1, the cooktop 2 may be illuminated. For example, the first direction D1 may be the down direction.

A user may perform actions, such as cooking, cutting a cooking material with a cooking tool, etc., on the cooktop 2. Since the actions require visibility, lighting may be needed for a user to perform various actions on the cooktop 2.

Particularly, the range hood 1 positioned above the cooktop 2 may make a shadow by other light separate from the light source device Y, and accordingly, the cooktop 2 may be darkened. In this environment, light may need to be emitted to the cooktop 2 to cook a cooking material on the cooktop 2.

Figure 15:
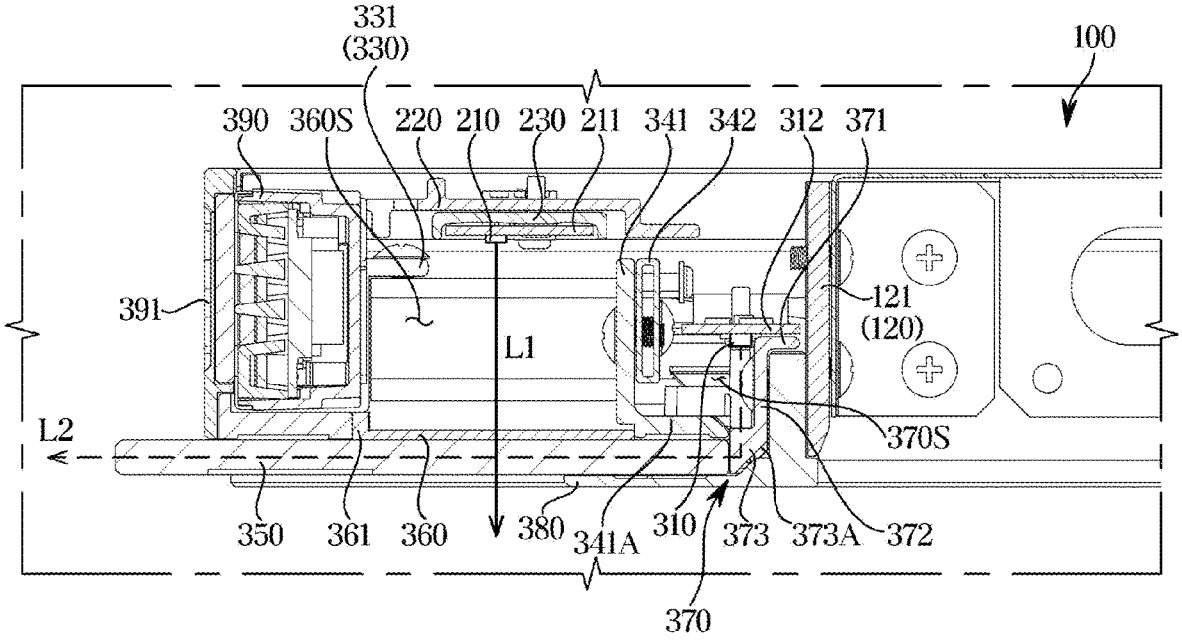
FIG. 15 is a cross-sectional view of a light source device of the range hood shown in FIG. 10.

Light illuminated onto the cooktop 2 may be illumination light L1 (see FIG. 15). An illumination light source 210 as a first light source which will be described below may emit such illumination light L1. The illumination light L1 may be emitted in the first direction D1 (see FIG. 2). The illumination light source 210 may be a light emitting diode (LED).

The light source device Y may irradiate light in a second direction D2 that intersects the first direction D1. By irradiating light in the second direction D2, an outer appearance of the range hood 1 may be decorated. For example, the second direction D2 may be a front direction or a rear direction.

Light emitted in the second direction D2 may include information about the range hood 1, such as a state or status of the range hood 1. Since the second direction D2 intersects the first direction D1, the second direction D2 may be better recognized by a user positioned at the front of the range hood 1, than the first direction D1. Accordingly, the range hood 1 may be decorated or have an aesthetic appearance by light emitted in the second direction D2. Alternatively, light emitted in the second direction D2 may be used to enable a user to recognize information about the range hood 1.

Light emitted in the second direction D2 is referred to as guide light L2 (see FIG. A guide light source 310 as a second light source which will be described below may emit the guide light L2. The guide light L2 may be emitted by the light source in the second direction D2 (see FIG. 2).

Figure 3:
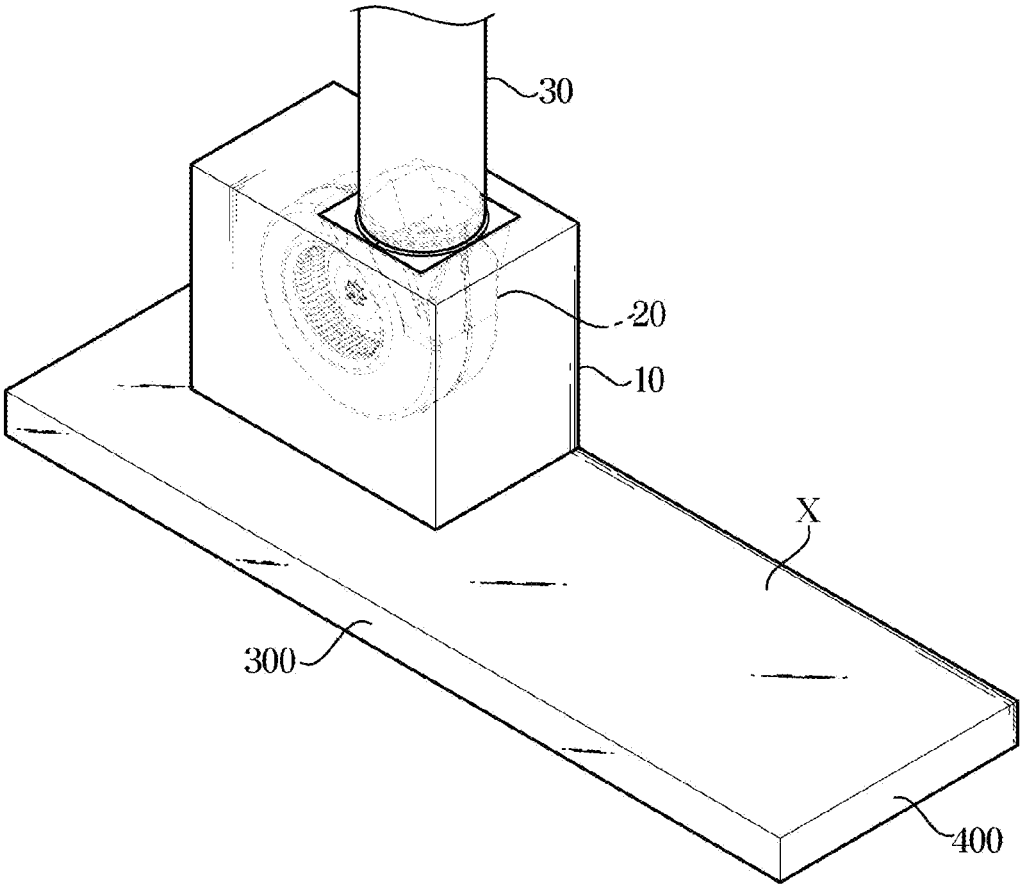
FIG. 3 is a perspective view of the range hood shown in FIG. 1.

FIG. 3 is a perspective view of the range hood 1 shown in FIG. 1.

Referring to FIG. 3, exhaustion of the range hood 1 will be described.

The range hood 1 may include the exhaust fan 20. The exhaust fan 20 may be a fan for exhausting pollutants entered the range hood 1.

The exhaust fan 20 may be positioned inside the duct 10.

The exhaust fan 20 may be an axial-flow fan.

While the exhaust fan 20 operates, pollutants or air below the main body X may move toward the main body X by operation of the exhaust fan 20 providing an airflow toward the main body X.

The exhaust fan 20 may suck pollutants or air into the range hood 1, and discharge the pollutants or air toward the exhaust pipe 30 provided above the duct 10 and outside of the range hood 1. The pollutants or air discharged toward the exhaust pipe 30 may move along the exhaust pipe 30 and then be discharged to the outside (e.g., outside of the range hood 1).

FIG. 4 is a perspective view of the main body X of the range hood 1 shown in FIG. 3.

Referring to FIG. 4, the main body X according to an embodiment of the disclosure will be described.

The range hood 1 may include the main body X.

The main body X may include the housing 100.

A duct connecting hole 111H may be defined in or by portions of the housing 100. The duct connecting hole 111H may be a hole communicating with the duct 10. That is, an inner area of the main body X may be in communication with an inner area of the duct 10, through the duct connecting hole 111H.

Oil mist generated from a cooking material may move toward the duct 10, through the duct connecting hole 111H.

The duct connecting hole 111H may be in a shape of a rectangle, although not limited thereto. The duct connecting hole 111H may have a shape corresponding to a shape of the duct 10.

The duct connecting hole 111H may be formed by cutting the housing 100, such as to remove a portion (or planar area) of the housing corresponding to a shape of the duct 10.

The main body X may include a duct connecting portion 111 connected with the duct 10. The duct connecting portion 111 may be a component connected with the duct That is, the main body X may be connected to the duct 10, at the duct connecting portion 111.

The duct connecting portion 111 may extend from a portion of the housing 100 and toward the duct 10. The duct connecting portion 111 may extend upward, that is, to an outer side of the housing 100.

The duct connecting portion 111 may extend to an inner side of the duct 10. Accordingly, since the duct connecting portion 111 is accommodated at an inner space of the duct 10, visibility of the duct connecting portion 111 from an outer side of the duct 10 may be reduced or effectively prevented. Since the duct connecting portion 111 is not visible from the outer side of the duct 10, an aesthetic sense of the duct 10 (e.g., an outer appearance) may be improved.

The duct connecting portion 111 may be bent from the housing 100. The duct connecting portion 111 may be integrated into the housing 100. That is, a portion of the housing 100 may be bent to define the duct connecting portion 111.

The duct connecting portion 111 may be adjacent to the duct connecting hole 111H, such as extending from an outer edge of the duct connecting hole 111H, at one or more edges thereof. Oil mist passing through the duct connecting hole 111H may be smoothly guided along the duct connecting portion 111.

The duct connecting portion 111 may have corners chamfered. Accordingly, the duct connecting portion 111 may be easily positioned inside the duct 10. Referring to FIG. 4, for example, a distal end of the bent portion of the housing 100 which is furthest from a planar portion of the housing 100, may include a chamfered corner.

Figure 5:
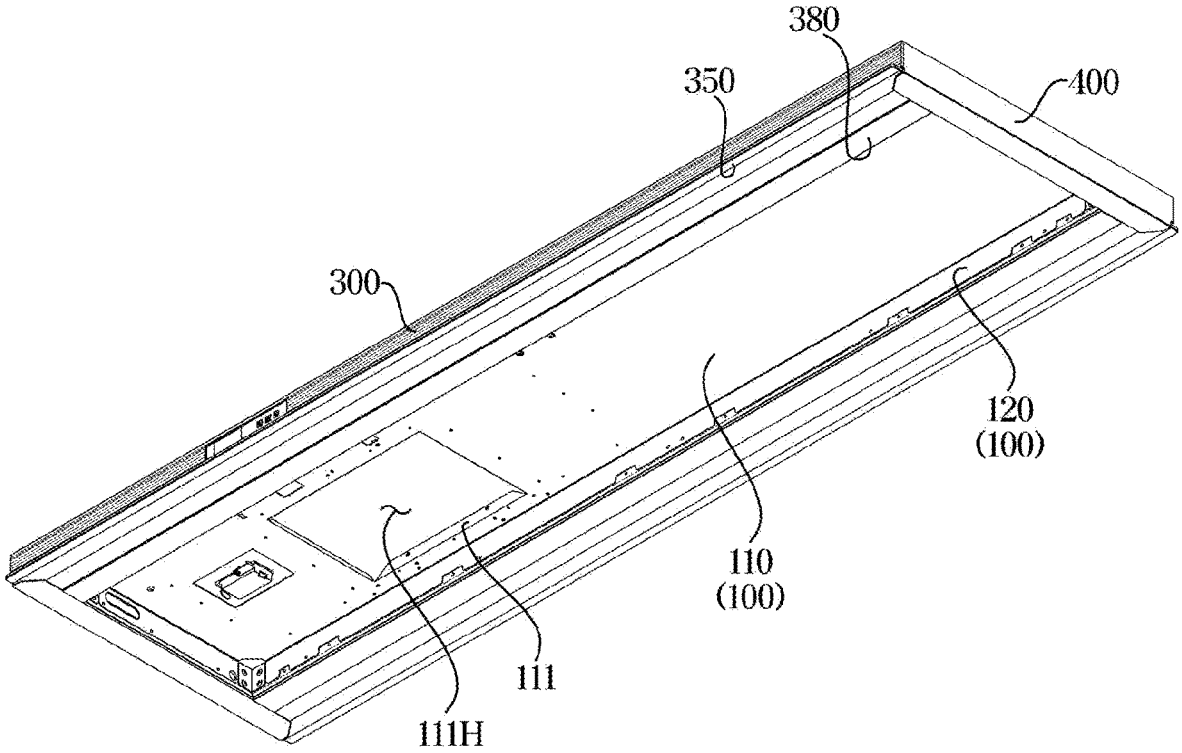
FIG. 5 is a perspective view of the main body of the range hood shown in FIG. 4, seen in another direction.

FIG. 5 is a perspective view of the main body X of the range hood 1 shown in FIG. 4, seen in another direction. FIG. 5 may provide a rear perspective view of the main body X, in a direction opposite to the first direction D1 (see FIG. 2), while FIG. 4 provides a top perspective view in the first direction D1.

Referring to FIG. 5, the main body X of the range hood 1 according to the disclosure will be described in more detail.

The range hood 1 may include the rail module 400 coupled to one side of the housing 100.

A plurality of rail modules 400 may be provided. The plurality of rail modules 400 may include a first rail module 400*a* coupled to the housing 100 at the left side of the housing 100, and a second rail module 400*b* coupled to the housing at the right side of the housing 100 which is opposite to the left side (see FIG. 6).

The first rail module 400*a* and the second rail module 400*b* may support the light source module 300 at a left or right side of the light source device Y, respectively.

The first rail module 400*a* and the second rail module 400*b* may guide a sliding movement of the light source module 300, relative to a remainder of the housing 100.

The first rail module 400*a* and the second rail module 400*b* may be coupled to the housing 100 at a lower portion of the housing 100. The first rail module 400*a* and the second rail module 400*b* may respectively define outer appearances of a left lower side and a right lower side of the main body X.

The first rail module 400*a* and the second rail module 400*b* may substantially define outer appearances corresponding to left and right corners of the main body X.

The range hood 1 may include the light source module 300 coupled to one side of the housing 100, such as among a front side and a rear side of the housing 100.

A plurality of light source modules 300 may be provided. The plurality of light source modules 300 may include a first light source module 300*a* coupled to the housing 100 at the front portion or front side of the housing 100, and a second light source module 300*b* coupled to the housing 100 at the rear portion or rear side of the housing 100.

The first light source module 300*a* and the second light source module 300*b* may respectively irradiate guide light L2 in the front or rear direction from the front and rear portions of the housing 100.

The first light source module 300*a* and the second light source module 300*b* may be coupled to the housing 100 at the lower portion of the housing 100 which is closest to the cooktop 2. The first light source module 300*a* and the second light source module 300*b* may respectively define an outer appearance of a front lower portion of the main body X and an outer appearance of a rear lower portion of the main body X.

The first light source module 300*a* and the second light source module 300*b* may substantially define outer appearances corresponding to front and rear edges of the main body X.

The first light source module 300*a* and the second light source module 300*b* may be supported by the rail modules 400.

The first light source module 300*a* and the second light source module 300*b* may be in contact with the rail modules 400.

The first light source module 300*a* and the second light source module 300*b* may be positioned at locations corresponding to front and rear edges of the housing 100. The first rail module 400*a* and the second rail module 400*b* may be positioned at locations corresponding to left and right edges of the housing 100.

In the housing 100 being in a shape of a rectangle, the edges of the housing 100 may be surrounded by the first and second light source modules 300*a* and 300*b* together with the first and second rail modules 400*a* and 400*b*. Accordingly, an outer appearance of a lower portion of the main body X may be defined by the first and second light source modules 300*a* and 300*b* together with the first and second rail modules 400*a* and 400*b*.

Figure 6:
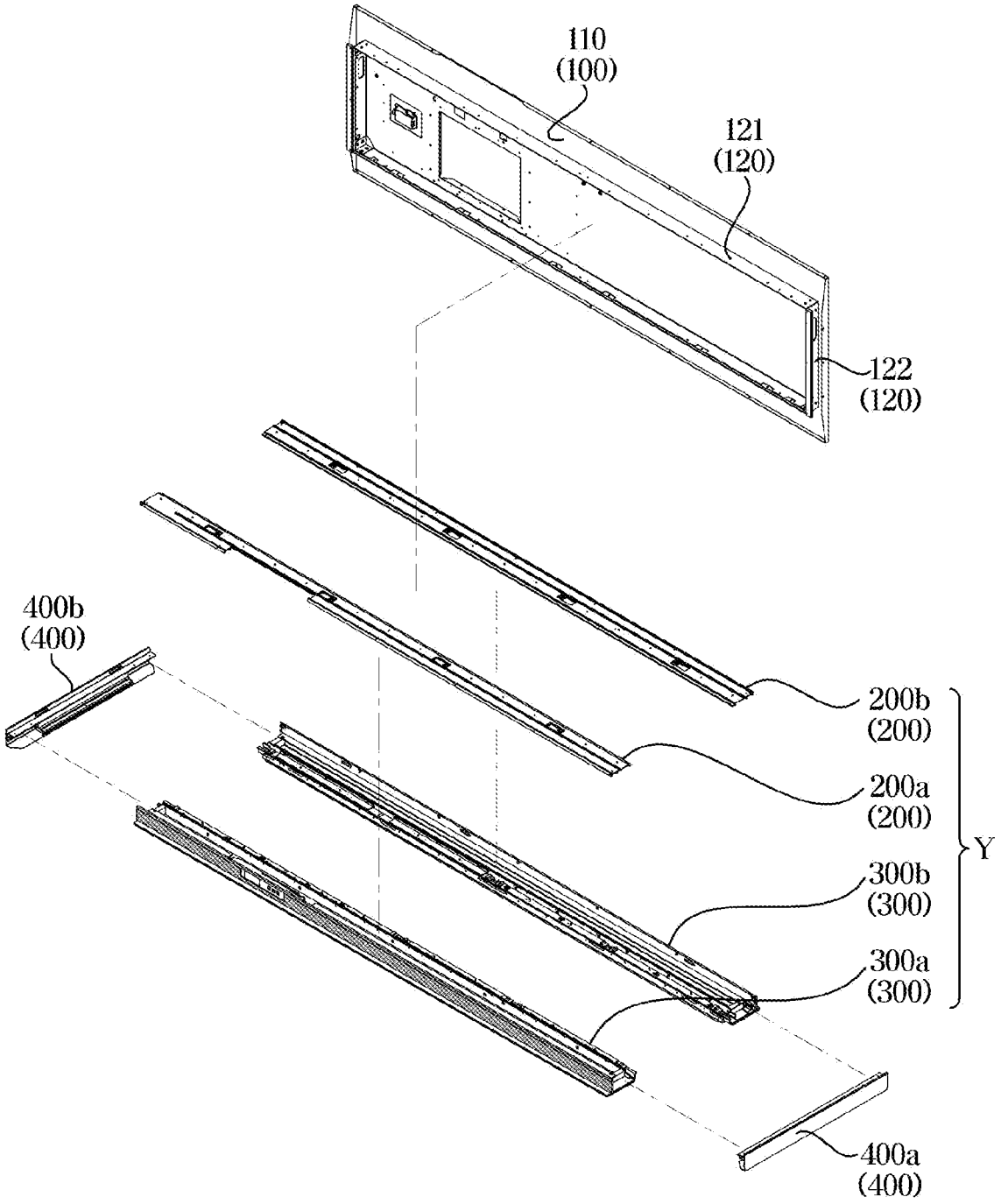
FIG. 6 is an exploded view of the main body of the range hood shown in FIG. 4.

The light source module 300 may include a transparent member 350 and a cover member 380 which covers a portion of the transparent member 350 (see FIG. 6). The transparent member 350 and the cover member 380 may define a lower outer appearance of the light source module 300.

The light source module 300 may be detachably coupled to the housing 100.

The light source module 300 may be movable from an accommodation location at which the light source module 300 is positioned inside the rail module 400, to a separation location at which the light source module 300 is positioned outside the rail module 400.

The rail module 400 may be in contact with the transparent member 350 and the cover member 380. Accordingly, an outer appearance corresponding to lower edges of the main body X may be defined by the transparent member 350 together with the cover member 380 and the rail module 400. Since the outer appearance of the lower portion of the main body X is defined by a small number of members, an aesthetic sense of the lower portion of the main body X may be improved.

The rail module 400 may move the light source module 300 in a sliding direction D3.

FIG. 6 is an exploded view of the main body X of the range hood 1 shown in FIG. 4.

Referring to FIG. 6, the main body X according to an embodiment of the disclosure will be described.

The range hood 1 may include the main body X.

The main body X may include the housing 100.

The housing 100 may include a housing plate 110. The housing plate 110 may be a component defining an outer appearance of the housing 100.

The housing plate 110 may define a portion of the outer appearance of the main body X. The housing plate 110 may define an outer appearance of the upper portion of the main body X.

The housing plate 110 may cover the upper portion of the main body X. Accordingly, the housing plate 110 may prevent foreign materials from entering inside of the main body X.

The housing plate 110 may include the duct connecting portion 111. The housing plate 110 may be connected with the duct 10.

The housing plate 110 may be coupled to the light source device Y. The housing plate 110 may be coupled to the light source unit 200. The housing plate 110 may be coupled to the light source unit 200. The housing plate 110 may be coupled to an upper portion of the light source unit 200. The housing plate 110 may cover the upper portion of the light source unit 200. The housing plate 110 may prevent foreign materials from entering the upper portion of the light source unit 200.

The housing plate 110 may be substantially in a shape of a rectangular plate, although not limited thereto. The housing plate 110 may have a shape corresponding to a shape of the cooktop 2.

The housing plate 110 may include a metal material, although not limited thereto. However, the housing plate 110 may include a plastic material.

The housing plate 110 may be formed by a press process, although not limited thereto.

The housing 100 may include a part housing 120. The part housing 120 may be a component or a part of the housing 100 to which another component included in the main body X is coupled.

The part housing 120 may be coupled to the housing plate 110. The part housing 120 may be coupled to the housing plate 110 at a lower portion of the housing plate 110. The part housing 120 may be a protruded portion of the housing 100 which extends from a rear side of the housing plate 110.

The part housing 120 may extend from the housing plate 110 toward the cooktop 2. The part housing 120 may extend downward, that is, in the first direction D1. Accordingly, another component may be coupled to a side surface of a portion of the part housing 120, extending toward the cooktop 2.

The part housing 120 may be coupled to the light source module 300 or the rail module 400. A side surface of the part housing 120 may be coupled to the light source module 300 or the rail module 400 by a coupling member.

The part housing 120 may be bent at a portion for coupling with the housing plate 110 and extend downward. Since the part housing 120 includes a portion facing the housing plate 110, coupling with the housing plate 110 may be reinforced. The housing plate 110 may be coupled to the part housing 120 by a coupling member.

The part housing 120 may extend along the edges of the housing 100. The part housing 120 may be long in a longitudinal direction.

The part housing 120 may face a rail frame 420 (see FIG. 7) to be coupled to the rail frame 420 by a coupling member.

The part housing 120 may include a module part housing 121. The module part housing 121 may be a first portion of a part housing 120 at which the light source module 300 is coupled to the housing 100.

The module part housing 121 may be coupled to the housing plate 110. The module part housing 121 may extend along edges of the housing plate 110. The module part housing 121 may extend along a longer side of the housing plate 110. The module part housing 121 may be coupled to the housing plate 110 to be adjacent to the longer side of the housing plate 110.

The module part housing 121 may face the light source module 300. The module part housing 121 may be positioned in a front or rear portion of the rail module 400.

The module part housing 121 may extend along a direction in which the light source module 300 extends. The module part housing 121 may extend in a left-right direction. The direction in which the module part housing 121 extends may be parallel to the direction in which the light source module 300 extends.

A front or rear portion of the module part housing 121 may have a flat surface.

The module part housing 121 may be coupled to the light source module 300. The module part housing 121 may be in contact with a rear portion of the light source module 300. The light source module 300 may be in contact with the flat surface of the module part housing 121. The module part housing 121 may be coupled to the light source module 300 by a coupling member.

A plurality of module part housings 121 may be provided. The plurality of module part housings 121 may include a first module part housing 121*a* capable of being coupled to the first light source module 300*a*, and a second module part housing 121*b* capable of being coupled to the second light source module 300*b* (see FIG. 14).

The first module part housing 121*a* may be positioned in the front direction with respect to the second module part housing 121*b*. The second module part housing 121*b* may be positioned in the rear direction with respect to the first module part housing 121*a*. The first module part housing 121*a* may be coupled to the front portion of the housing plate 110. The second module part housing 121*b* may be coupled to the rear portion of the housing plate 110.

The first module part housing 121*a* may be coupled to the first light source module 300*a* at a rear portion of the first light source module 300*a*. The first light source module 300*a* may be coupled to the first module part housing 121*a* at a front portion of the first module part housing 121*a*.

The second module part housing 121*b* may be coupled to the second light source module 300*b* at a front portion of the second light source module 300*b*. The second light source module 300*b* may be coupled to the second module part housing 121*b* at a rear portion of the second module part housing 121*b*.

A direction in which the first module part housing 121*a* extends may be parallel to a direction in which the second module part housing 121*b* extends. An extension direction of the first light source module 300*a* coupled to the first module part housing 121*a* may be parallel to an extension direction of the second light source module 300*b* coupled to the second module part housing 121*b*.

The first and second module part housings 121*a* and 121*b* may include a metal material, although not limited thereto.

The first and second module part housings 121*a* and 121*b* may be formed by a drawing process or an extruding process, although not limited thereto.

The part housing 120 may include a rail part housing 122. The rail part housing 122 may be a second portion of the part housing 120 at which the rail module 400 is coupled to the housing 100.

In an embodiment, the hood body (e.g., the main body X together with the housing 100) may include a housing plate 110 facing the cooktop 2 in the first direction D1 and having an outer edge, and a frame portion which protrudes in the first direction D1 from the housing plate 110 and extends along the outer edge of the housing plate 110, the frame portion being spaced apart from the outer edge of the housing plate 110. The frame portions may be a collection of the module part housing 121 and the rail part housing 122. The light source device Y is connected to the frame portion (for example, at the module part housing 121) and extends from the frame portion to the outer edge of the housing plate 110 (see FIG. 15 which shows components of the light source device Y to the left of the module part housing 121).

The rail part housing 122 may be coupled to the housing plate 110. The rail part housing 122 may extend along the edges of the housing plate 110. The rail part housing 122 may extend along a shorter side of the housing plate 110. The rail part housing 122 may be coupled to the housing plate 110 to be adjacent to a shorter side of the housing 100.

The rail part housing 122 may face the rail module 400. The rail part housing 122 may be positioned in a left or right portion of the module part housing 121.

The rail part housing 122 may extend along a direction in which the rail module 400 extends. The rail part housing 122 may extend in a front-rear direction. The direction in which the rail part housing 122 extends may be parallel to the direction in which the rail module 400 extends.

The rail part housing 122 may have a flat surface at the right or left side.

The rail part housing 122 may be coupled to the rail module 400. The rail part housing 122 may be in contact with a side portion of the rail module 400. The flat surface of the rail part housing 122 may be in contact with the rail module 400. The rail part housing 122 may be coupled to the rail module 400 by a coupling member.

A plurality of rail part housings 122 may be provided. The plurality of rail part housings 122 may include a first rail part housing 122*a* capable of being coupled to the first rail module 400*a*, and a second rail part housing 122*b* capable of being coupled to the second rail module 400*b* (see FIG. 14).

The first rail part housing 122*a* may be positioned in the right direction with respect to the second rail part housing 122*b*. The second rail part housing 122*b* may be positioned in the left direction with respect to the first rail part housing 122*a*. The first rail part housing 122*a* may be coupled to a left portion of the housing plate 110. The second rail part housing 122*b* may be coupled to a right portion of the housing plate 110.

The first rail part housing 122*a* may be coupled to the first rail module 400*a* at a right portion of the first rail module 400*a*. The first rail module 400*a* may be coupled to the first rail part housing 122*a* at a left portion of the first rail part housing 122*a*.

The second rail part housing 122*b* may be coupled to the second rail module 400*b* at a left portion of the second rail module 400*b*. The second rail module 400*b* may be coupled to the second rail part housing 122*b* at a right portion of the second rail part housing 122*b*.

A direction in which the first rail part housing 122*a* extends may be parallel to a direction in which the second rail part housing 122*b* extends. An extension direction of the first rail module 400*a* coupled to the first rail part housing 122*a* may be parallel to an extension direction of the second rail module 400*b* coupled to the second rail part housing 122*b*.

The first and second rail part housings 122*a* and 122*b* may include a metal material, although not limited thereto.

The first and second rail part housings 122*a* and 122*b* may be formed by a drawing process, although not limited thereto.

The main body X may include the light source unit 200. The light source unit 200 may be a component capable of irradiating light in the first direction D1, such as to define a light source of the light source device Y.

The light source unit 200 may be coupled to the housing plate 110. The light source unit 200 may be coupled to the lower portion of the housing plate 110. The light source unit 200 may be coupled to the housing plate 110 by a coupling member.

The light source unit 200 may be positioned in front of or behind the module part housing 121. The light source unit 200 may be positioned to correspond to the light source module 300 which will be described below. The light source unit 200 may be positioned above the light source module 300.

The light source unit 200 may extend in a direction being parallel to an extension direction of the light source module 300.

The light source unit 200 may be adjacent to the longer side of the housing plate 110. The light source unit 200 may extend along the longer side of the housing plate 110.

The light source unit 200 may irradiate light toward the light source module 300.

The light source unit 200 may be included in the light source device Y.

A plurality of light source units 200 may be provided. The plurality of light source units 200 may include a first light source unit 200*a* corresponding to the first light source module 300*a*, and a second light source unit 200*b* corresponding to the second light source module 300*b*.

The first light source unit 200*a* may be adjacent to the first module part housing 121*a*, that is, closer to the first module part housing 121*a* than the second module part housing 121*b*. The second light source unit 200*b* may be adjacent to the second module part housing 121*b*, that is, closer to the second module part housing 121*b* than the first module part housing 121*a*.

The first light source unit 200*a* may be positioned in the front direction with respect to the second light source unit 200*b*. The second light source unit 200*b* may be positioned in the rear direction with respect to the first light source unit 200*a*.

The main body X may include the light source module 300. The light source module 300 may be a component capable of irradiating light in the second direction D2 as a light emitting direction.

The light source module 300 may face the light source unit 200. Accordingly, light irradiated from the light source unit 200 may pass through the light source module 300. That is, a light emitting direction may be defined from the light source unit 200 to the light source module 300 which faces the light source unit 200.

The light source module 300 may face the module part housing 121. The light source module 300 may be coupled to the module part housing 121.

The light source module 300 may be adjacent to the rail module 400. The light source module 300 may be in contact with the rail module 400. As being in contact, elements may form an interface therebetween, without being limited thereto.

The light source module 300 may extend in the longitudinal direction. The light source module 300 may extend to correspond to the longer side of the housing plate 110.

A plurality of light source modules 300 may be provided. The plurality of light source modules 300 may include a first light source module 300*a* coupled to the first module part housing 121*a*, and a second light source module 300*b* coupled to the second module part housing 121*b*.

The first light source module 300*a* may be positioned in the front direction with respect to the second light source module 300*b*. The second light source module 300*b* may be positioned in the rear direction with respect to the first light source module 300*a*.

The main body X may include the rail module 400. The rail module 400 may be a component for guiding a movement of the light source module 300.

The rail module 400 may support the light source module 300 in a direction of gravity of the light source module 300. The rail module 400 may support the light source module 300 at a side end of the light source module 300.

The rail module 400 may be coupled to the rail part housing 122.

The rail module 400 may extend along the shorter side of the housing plate 110.

A plurality of rail modules 400 may be provided. The rail modules 400 may include a first rail module 400*a* coupled to the first rail part housing 122*a*, and a second rail module 400*b* coupled to the second rail part housing 122*b*.

The first rail module 400*a* may be positioned in the left direction with respect to the second rail module 400*b*. The second rail module 400*b* may be positioned in the right direction with respect to the first rail module 400*a*.

Figure 7:
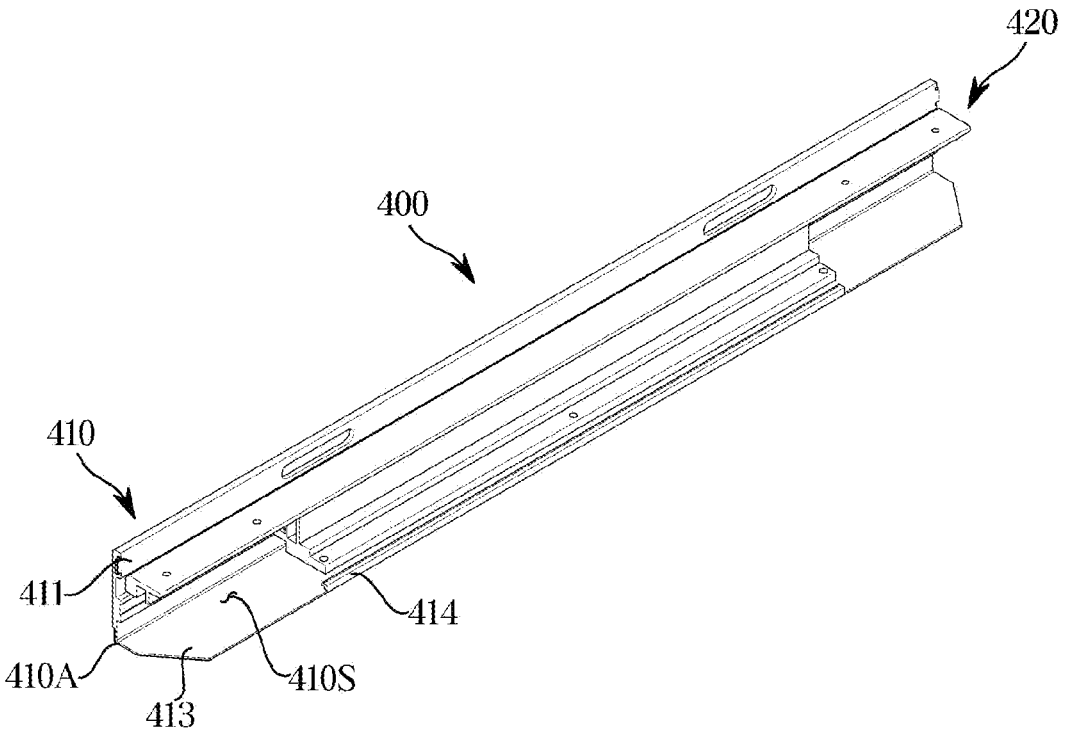
FIG. 7 is a perspective view showing a rail module of the range hood shown in FIG. 6.

FIG. 7 is a perspective view showing the rail module 400 of the range hood 1 shown in FIG. 6.

Referring to FIG. 7, the rail module 400 according to an embodiment of the disclosure will be described.

The range hood 1 may include the rail module 400.

The rail module 400 may include a rail cover 410. The rail cover 410 may be a component covering one side of the housing 100.

The rail cover 410 may face the housing plate 110. Accordingly, the rail cover 410 may cover at least one portion of the housing plate 110.

Figure 9:
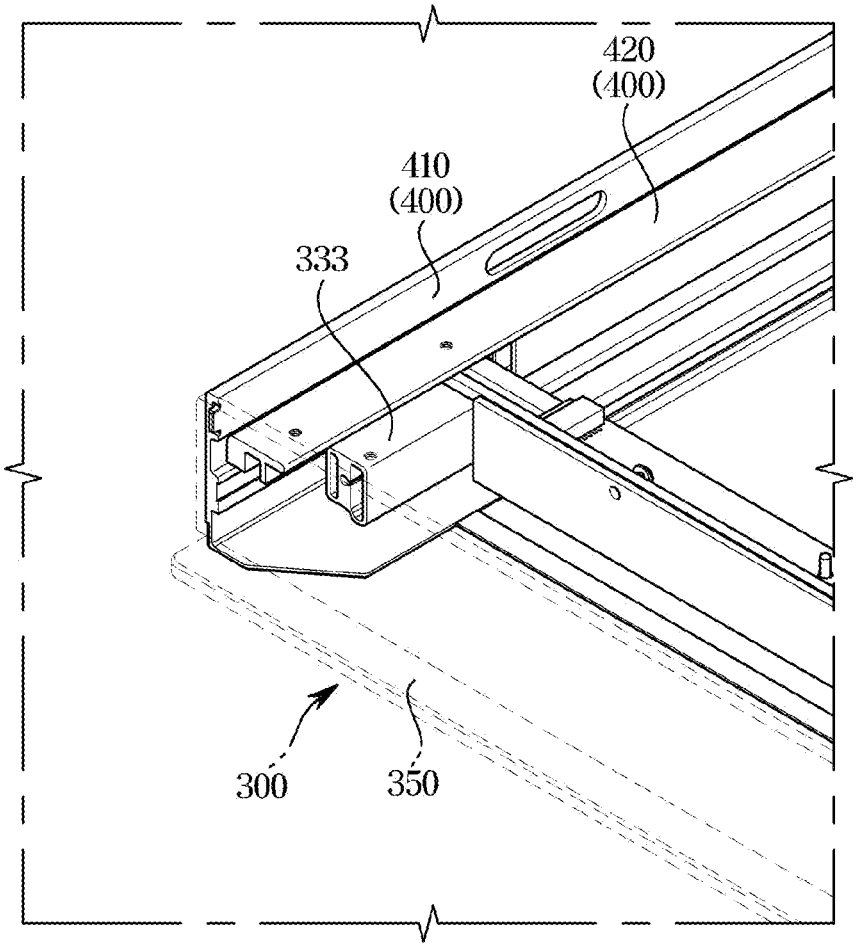
FIG. 9 is an enlarged view showing a state after the light source module of the range hood shown in FIG. 8 is coupled to the rail module.

The rail cover 410 may extend along the shorter side of the housing plate 110 (see FIG. 9).

The rail cover 410 may be in a shape of a bent plate.

The rail cover 410 may support the light source module 300 positioned at the accommodation location, at an end in longitudinal direction of the light source module 300.

The rail cover 410 may include a module supporting portion 413. The module supporting portion 413 may be a component or define a surface along which the light source module 300 is supported, slidably disposed, etc.

The module supporting portion 413 may be in contact with the light source module 300. The module supporting portion 413 may be in contact with the transparent member 350 to support the light source module 300.

The module supporting portion 413 may be positioned in the first direction D1 with respect to the housing 100. The module supporting portion 413 may be positioned on the lower portion of the housing 100. The module supporting portion 413 may define a lower outer appearance of the housing 100.

The module supporting portion 413 may be adjacent to the cover member 380. The module supporting portion 413 may be in contact with the cover member 380. The module supporting portion 413 may define an aesthetic sense of being integrated into the cover member 380.

The module supporting portion 413 may extend along the shorter side of the housing plate 110.

The module supporting portion 413 may protrude from a vertical portion or plate portion of the rail cover 410, in the left-right direction.

The module supporting portion 413 may be in a shape of a plate. The module supporting portion 413 may have a longer side in the front-rear direction. The module supporting portion 413 may have a shorter side in the left-right direction.

The module supporting portion 413 may be positioned in the direction of gravity with respect to the light source module 300 to be in contact with and support the light source module 300 being at the accommodation location.

The module supporting portion 413 may define a sliding opening 410A positioned in the sliding direction D3 such that the light source module 300 is movable in the sliding direction D3 upon a movement of the light source module 300 from the accommodation location to the separation location.

The rail cover 410 may include a module cover 411. The module cover 411 may be a component covering the light source module 300.

The module cover 411 may extend from the module supporting portion 413, such as from a distal edge of the module supporting portion 413. The module cover 411 may extend in an opposite direction to the first direction D1, from the module supporting portion 413. The module cover 411 may extend upward from the module supporting portion 413.

The module cover 411 may extend from one end of the module supporting portion 413.

The module cover 411 may be positioned outside the housing 100.

The module cover 411 may be bent from the module supporting portion 413. The module supporting portion 413 may be bent to define the module cover 411.

The module cover 411 may extend along the shorter side of the housing plate 110. The module cover 411 may extend in the second direction D2, that is, may have a major dimension (or length) which extends along the second direction D2. The module cover 411 may extend in the front-rear direction.

The module cover 411 may protrude or extend in the up-down direction.

The module cover 411 may be in a shape of a plate. The module cover 411 may have a longer side (e.g., a major dimension) in the front-rear direction. The module cover 411 may have a shorter side (e.g., a minor dimension) in the up-down direction.

The module cover 411 may be positioned in the longitudinal direction from the light source module 300 being at the accommodation location to cover the light source module 300.

The sliding opening 410A may be defined by the module cover 411 together with the module supporting portion 413. The sliding opening 410A may be an opening into which the light source module 300 is slidably inserted into the rail module 400. The sliding opening 410A may be open to outside the rail module 400 at a front side or a rear side of the rail module 400. The sliding opening 410A may be positioned in a front or rear portion in a front or rear portion of the rail module 400.

A sliding space 410S may be provided by the module cover 411 together with the module supporting portion 413. The sliding space 410S may be a space capable of accommodating the light source module 300. The sliding space 410S may be positioned in an inner side from the sliding opening 410A.

The rail module 400 may include the rail frame 420. The rail frame 420 may be a component coupled to the rail cover 410.

The rail frame 420 may be coupled to an inner side of the rail cover 410. The rail frame 420 may be coupled to the module cover 411. By coupling of the rail frame 420 to the rail cover 410, strength of the rail cover 410 may increase.

The rail frame 420 may extend along the shorter side of the housing plate 110.

A width of the rail frame 420 may correspond to a width of the module supporting portion 413, where the width is defined along the left-right direction. Accordingly, the rail frame 420 may be accommodated at an inner side of the rail cover 410.

The sliding space 410S may be provided in a front or rear portion of the rail frame 420.

The rail frame 420 may be prevented from being positioned in the sliding space 410S. The reason may be because the rail frame 420 positioned in the sliding space 410S prevents guide light L2 from being diffused up to a left or right end of the transparent member 350. To diffuse guide light L2, the rail frame 420 may be prevented from being positioned in the sliding space 410S.

The rail frame 420 may extend toward the sliding direction D3 such that the sliding space 410S for accommodating the light source module 300 is provided in the inner side of the rail cover 410.

The frail frame 420 may include a metal material, although not limited thereto.

The rail frame 420 may be formed by a drawing process, although not limited thereto.

Figure 8:
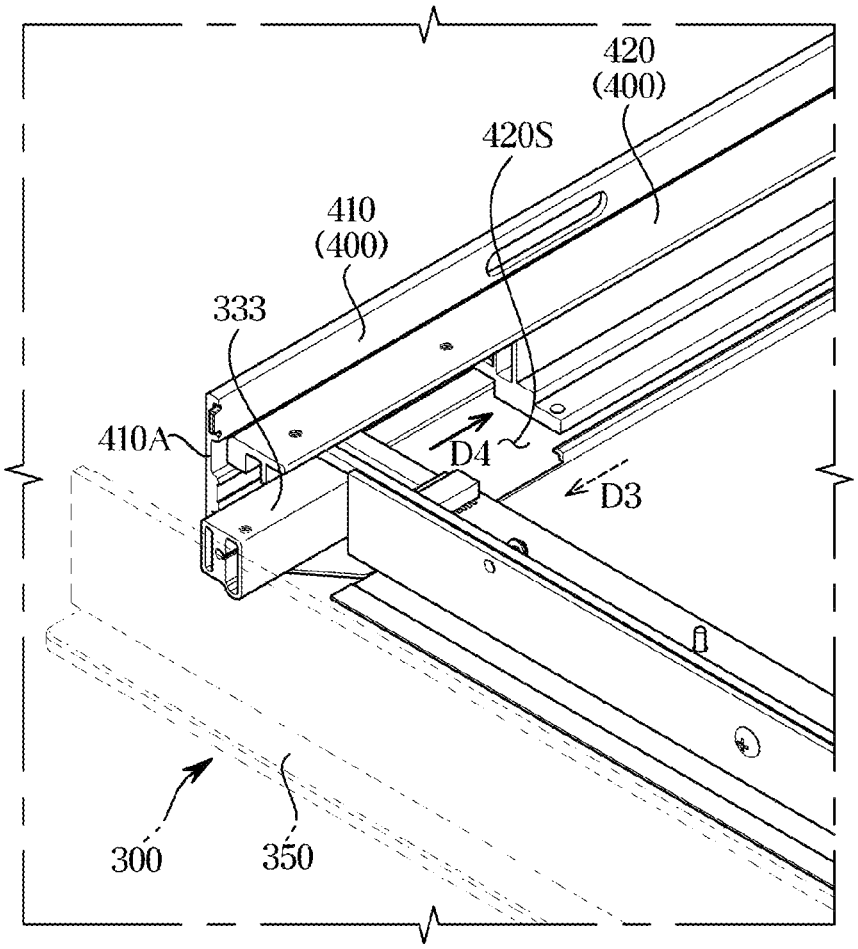
FIG. 8 is an enlarged view showing a state in which a light source module of the range hood shown in FIG. 4 is coupled to the rail module.

FIG. 8 is an enlarged view showing a state before the light source module 300 of the range hood 1 shown in FIG. 4 is coupled to the rail module 400. FIG. 9 is an enlarged view showing a state after the light source module 300 of the range hood 1 shown in FIG. 8 is coupled to the rail module 400.

Referring to FIGS. 8 and 9, an operation of inserting the light source module 300 according to an embodiment of the disclosure into the rail module 400 will be described.

The range hood 1 may include the light source module 300 and the rail module 400.

The light source module 300 may be supported by the first rail module 400*a* and the second rail module 400*b*.

The rail module 400 may guide a sliding movement of the light source module 300 along a short side of the housing 100.

It is confirmed that the light source module 300 is separated from the rail module 400 (FIG. 8) and then again accommodated in the rail module 400 (FIG. 9).

A location at which the light source module 300 is inserted in the sliding space 410S defined in the rail module 400 may be referred to as the accommodation location. A location at which the light source module 300 is separated from or disposed outside of the sliding space 410S may be referred to as the separation location.

The light source module 300 may be movable from the accommodation location to the separation location. The light source module 300 may be movable from the separation location to the accommodation location.

A movement of the light source module 300 from the separation location to the accommodation location will be described. A movement of the light source module 300 from the accommodation location to the separation location may be a reverse process of a movement of the light source module 300 from the separation location to the accommodation location.

While the light source module 300 moves from the separation location to the accommodation location, the light source module 300 may pass through the sliding opening 410A and move in an opposite direction to the second direction D2.

A direction in which the light source module 300 moves from the separation location to the accommodation location may be referred to as a sliding accommodation direction D4. A direction in which the light source module 300 moves from the accommodation location to the separation location may be referred to as the sliding direction D3 (or sliding separation direction).

The sliding direction D3 may be Identical to the second direction D2. However, because a traveling direction of guide light L2 may be not identical to a movement direction of the light source module 300, the sliding direction D3 may be different from the second direction D2.

While the light source module 300 moves in the sliding accommodation direction D4, the transparent member 350 may move while being in contact with the module supporting portion 413 of the rail cover 410.

A movement in direction of gravity of the light source module 300 may be blocked by the module supporting portion 413.

The light source module 300 may move along the rail module 400 in the sliding direction D3 and the sliding accommodation direction D4, while being limited in moving in the left-right direction, by the module cover 411 of the rail cover 410.

The light source module 300, which is at the accommodation location, may be positioned inside the sliding space 410S. That is, the light source module 300 which is accommodated within the rail module 400 includes the light source module 300 within the sliding space 410S, as shown in FIG. 9

A movement in sliding accommodation direction D4 of the light source module 300 may be blocked by contact of a portion of the light source module 300 with a front end of the rail frame 420. The light source module 300 may be positioned at the accommodation location by contacting the rail frame 420. In FIG. 8, for example, a dotted line portion of the light source module 300 is shown spaced apart from a front end of the rail frame 420 along the sliding accommodation direction D4. However, FIG. 9 shows the dotted line portion of the light source module 300 in contact with the front end of the rail frame 420 such that the light source module 300 which is accommodated within the housing 100 includes the light source module 300 in contact with the rail frame 420.

Figure 10:
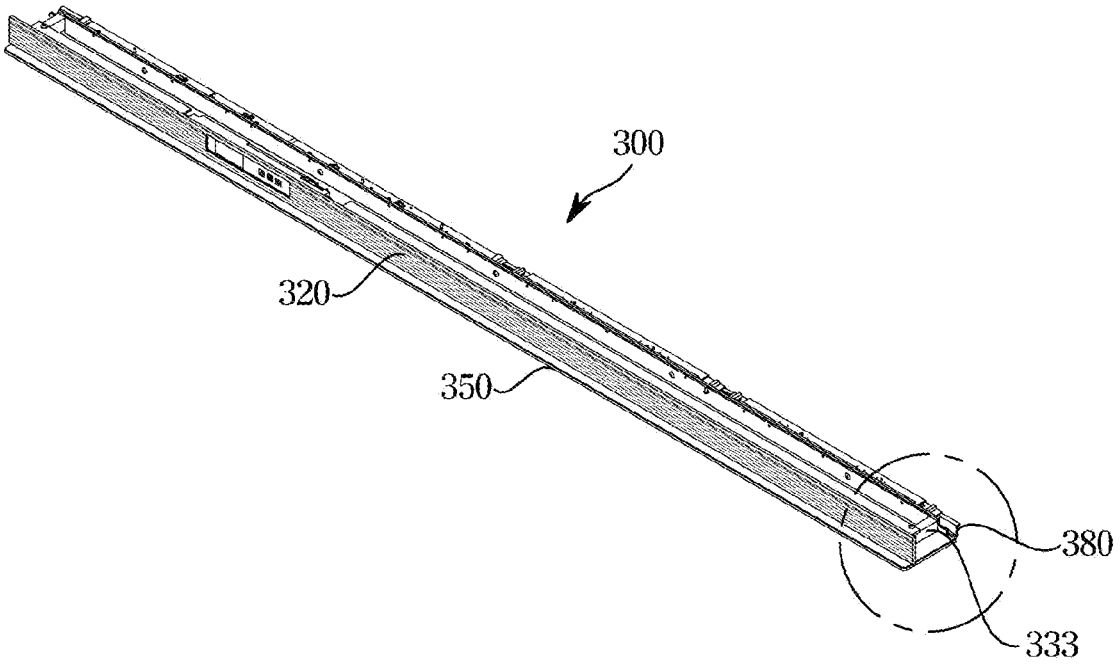
FIG. 10 is a perspective view of a light source module of the range hood shown in FIG. 6.
Figure 11:
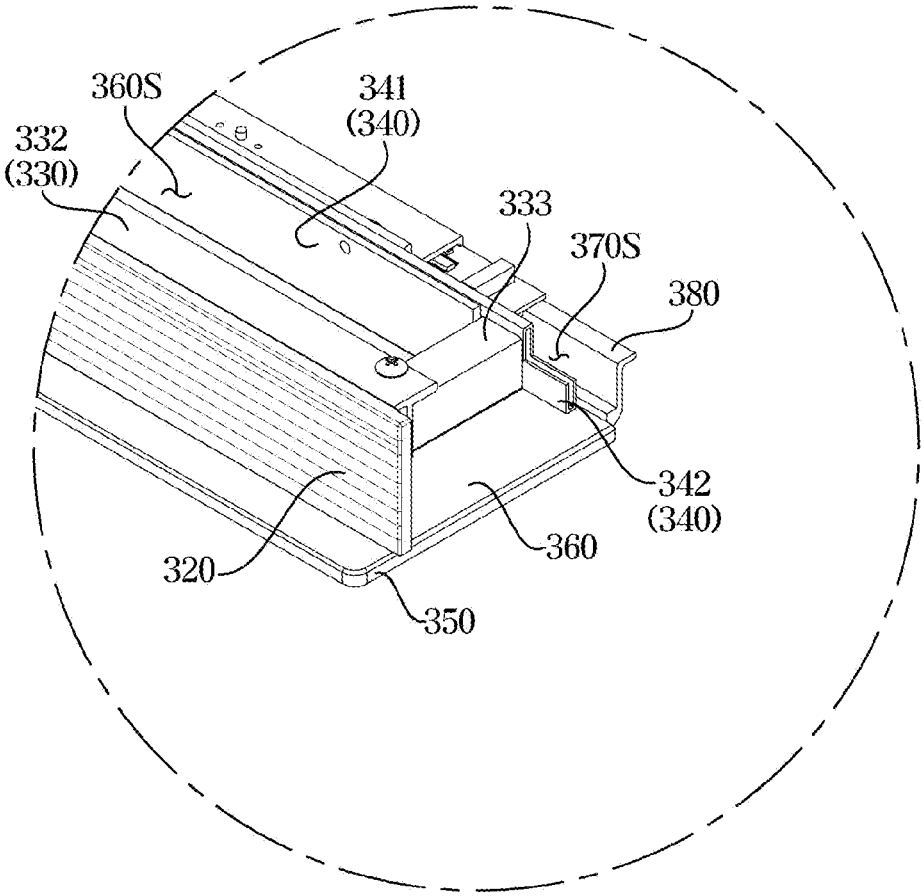
FIG. 11 is an enlarged view showing the light source module of the range hood shown in FIG. 10.
Figure 12:
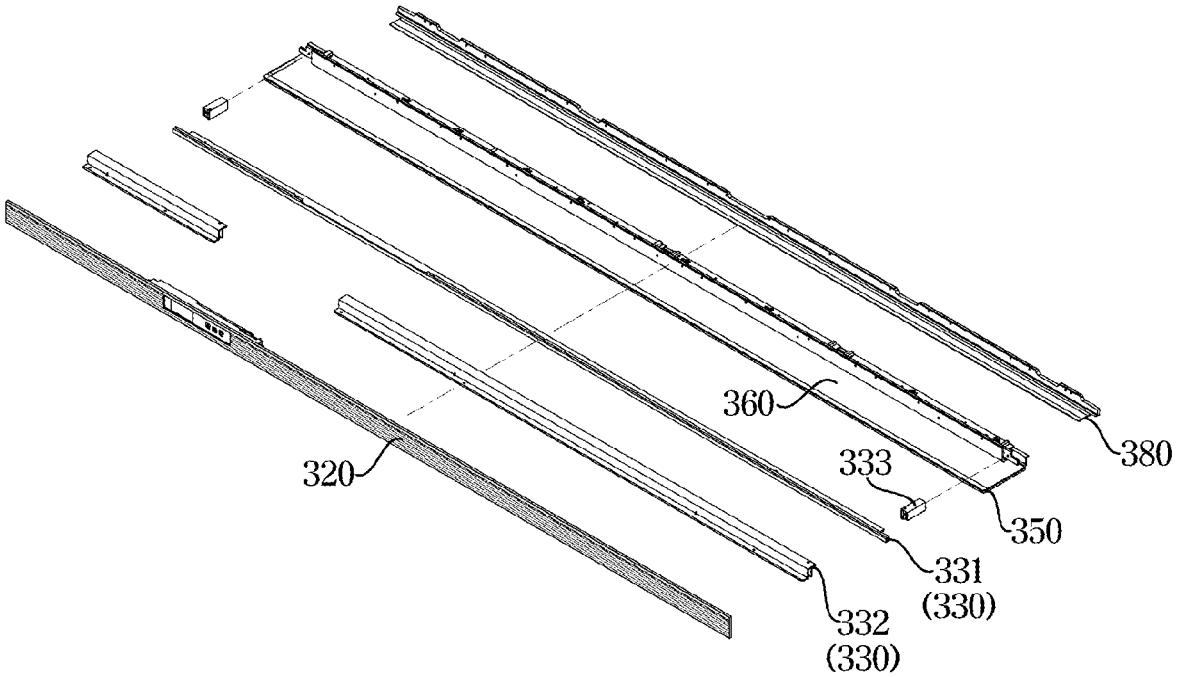
FIG. 12 is an exploded view of the light source module of the range hood shown in FIG. 10.
Figure 13:
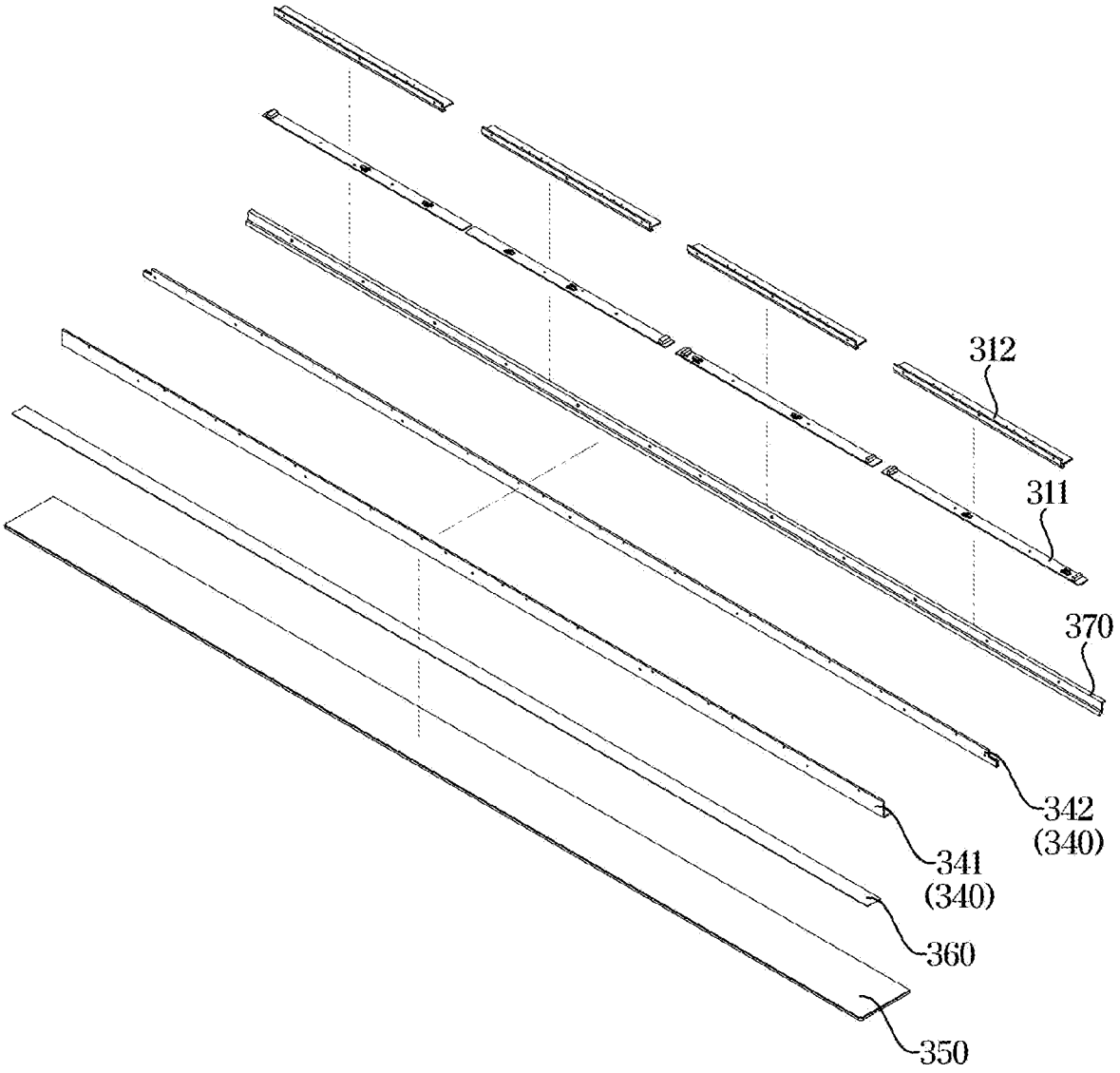
FIG. 13 is an exploded view of some components of the light source module of the range hood shown in FIG. 12.

FIG. 10 is a perspective view of the light source module 300 of the range hood 1 shown in FIG. 6. FIG. 11 is an enlarged view of the circled portion in FIG. 10. FIG. 12 is an exploded view of the light source module 300 of the range hood 1 shown in FIG. 10. FIG. 13 is an exploded view of some components of the light source module 300 of the range hood 1 shown in FIG. 12.

The light source module 300 in FIGS. 10 and 11 may correspond to the first light source module 300*a* in FIG. 6. It will be understood that the second light source module 300*b* in FIG. 6 may have a mirrored orientation to the structure shown in FIGS. and 11. The bracket supporting unit 330 may define a first sidewall of the light source module 300 (or the light source device Y). Taking FIG. 6 together with FIGS. 10 and 11, the bracket supporting unit 330 may be closer to an outer edge of the range hood 1 than the light source supporting unit 340. In FIGS. 10 and 11, as representing the first light source module 300*a*, the first sidewall provided by the bracket supporting unit 330 is in the second direction D2 from the light diffuser 360 and the light source supporting unit 340. Conversely, for the second light source module 300*b*, the first sidewall provided by the bracket supporting unit 330 is in the direction opposite to the second direction D2 from the light diffuser 360 and the light source supporting unit 340. In an embodiment, the light source device Y includes a first sidewall (defined by the bracket supporting unit 330) which is extended along the light source device Y, is on the transparent member 350 and is closer to the front side of the hood body than the light diffuser, a second sidewall (defined by the light source supporting unit 340) which is on the transparent member 350 and faces the first sidewall with the light diffuser therebetween, and a light diffusing space 360S defined by the light diffuser together with the first sidewall and the second sidewall. Here, the illumination light L1 passes in the first direction D1 through the light diffusing space 360S and both the transparent member 350 and the light diffuser, to the cooktop 2.

Referring to FIGS. 10 to 13, the light source module 300 according to an embodiment of the disclosure will be described.

The light source module 300 may include the transparent member 350. The transparent member 350 may be a component capable of transmitting illumination light L1 emitted from the light source unit 200.

The transparent member 350 may extend along a direction in which the light source module 300 extends.

The transparent member 350 may be in a shape of a rectangular plate, although not limited thereto.

The transparent member 350 may face the housing plate 110 (see FIG. 6). The transparent member 350 may also face the cooktop 2 (see FIG. 2). The transparent member 350 may have flat surfaces at the upper and lower portions.

The transparent member 350 may include a glass material, although not limited thereto.

The transparent member 350 may be formed or provided by a molding method, although not limited thereto.

The transparent member 350 may have a rear left corner or a rear right corner chamfered. Accordingly, a wire may be positioned without interruptions.

The light source module 300 may include a light diffuser 360. The light diffuser 360 may be a component capable of diffusing illumination light L1.

The light diffuser 360 may be positioned on the transparent member 350. The light diffuser 360 may be positioned on an upper surface of the transparent member 350, that is, on a side of the transparent member 350 which is opposite to the cooktop 2. The diffuser 360 may be supported by the transparent member 350.

The light diffuser 360 may be positioned between the transparent member 350 and the illumination light source 210 to diffuse illumination light L1. Illumination light L1 may pass through the light diffuser 360 and the transparent member 350 and then be emitted toward the cooktop 2.

The light diffuser 360 may be detachably supported by the transparent member 350. That is, a light diffuser (e.g., the light diffuser 360) may be removably attached to the hood body.

The transparent member 350 may extend in the sliding direction D3 to define an outer appearance in direction of gravity of the light source module 300.

The light diffuser 360 may extend in an extension direction of the light source module 300.

The light diffuser 360 may include a translucent plastic material, although not limited thereto.

The light diffuser 360 may be formed by a drawing process, although not limited thereto.

The light source module 300 may include a bracket supporting unit 330. The bracket supporting unit 330 may be a component forming a frame of the light source module 300.

The bracket supporting unit 330 may be adjacent to the light diffuser 360. The bracket supporting unit 330 may be positioned in a front or rear portion of the light diffuser 360. The bracket supporting unit 330 of the first light source module 300*a* may be positioned in the front portion of the light diffuser 360. The bracket supporting unit 330 of the second light source module 300*b* may be positioned in the rear portion of the light diffuser 360.

The bracket supporting unit 330 may support the light diffuser 360. The bracket supporting unit 330 may guide a location of the light diffuser 360. The bracket supporting unit 330 may fix the location of the light diffuser 360 by contacting the light diffuser 360.

The bracket supporting unit 330 may be positioned on the transparent member 350. The bracket supporting unit 330 may be in contact with the transparent member 350 on the transparent member 350. The bracket supporting unit 330 may be supported by the transparent member 350.

The bracket supporting unit 330 may extend along the extension direction of the light source module 300. The bracket supporting unit 330 may extend in the left-right direction.

The bracket supporting unit 330 may reinforce strength of the light source module 300.

That is, the bracket supporting unit 330 may be positioned on the transparent member 350, and positioned in the second direction D2 from the light diffuser 360.

The bracket supporting unit 330 may include a bracket supporting body 332. The bracket supporting body 332 may be a component supporting the bracket supporting unit 330.

The bracket supporting body 332 may be positioned on the transparent member 350. The bracket supporting body 332 may be supported by the transparent member 350.

The bracket supporting body 332 may be positioned inside the light source module 300.

The bracket supporting body 332 may extend in the longitudinal direction. The bracket supporting body 332 may extend along the longitudinal direction of the light source module 300. The bracket supporting body 332 may extend along a longer side of the transparent member 350.

The bracket supporting body 332 may be in contact with the light diffuser 360.

The bracket supporting body 332 may be a metal material, although not limited thereto.

The bracket supporting body 332 may be formed by a drawing process, although not limited thereto.

The bracket supporting body 332 may be coupled to a cover housing 320 as a housing cover.

The bracket supporting unit 330 may include a bracket 331. The bracket 331 may be a component corresponding to a frame of the light source module 300.

The bracket 331 may be positioned on the bracket supporting body 332. The bracket 331 may reinforce strength of the light source module 300 together with the bracket supporting body 332.

The bracket 331 may be coupled to the cover housing 320.

The bracket 331 may extend in the longitudinal direction of the light source module 300. The bracket 331 may extend along the bracket supporting body 332. The bracket 331 may extend along the longer side of the transparent member 350.

The bracket 331 may be substantially in a shape of a rectangular parallelepiped.

A cavity may be defined in an inner side of the bracket 331. The cavity formed in the inner side of the bracket 331 may extend along the longitudinal direction of the bracket 331. Accordingly, the light source module 300 may have a light weight. The light source module 300 having a light weight may be easily serviced. Also, a manufacturing cost of the light source module 300 may be reduced.

An upper portion of the bracket 331 may have a shape extending to an inner side of the light source module 300. Accordingly, a shape that is coupled to the housing 100 may be provided.

A lower portion of the bracket 331 may have a shape extending outward from the light source module 300. Accordingly, a shape to which the cover housing 320 is coupled may be provided.

The bracket 331 may include a metal material, although not limited thereto.

The bracket 331 may be formed by a drawing process, although not limited thereto.

The bracket 331 and the bracket supporting body 332 may define a light diffusing space 360S, together with the light diffuser 360. The light diffusing space 360S may be a space through which illumination light L1 passes.

Illumination light L1 may be diffused with a certain optical distance. In a case in which illumination light L1 is not diffused, the illumination light source 210 may be recognized through the transparent member 350, which may influence an aesthetic sense.

The light source module 300 may include a light source supporting unit 340. The light source supporting unit 340 may be a component forming a frame of the light source module 300.

The light source supporting unit 340 may include the bracket 331. The bracket 331 may be a component corresponding to the frame of the light source module 300.

The light source supporting unit 340 may be positioned on the transparent member 350 in the opposite direction of the second direction D2 from the light diffuser 360.

The bracket 331 may be positioned on a light source bracket supporting body 342. The bracket 331 may reinforce strength of the light source unit 200 together with the light source bracket supporting body 342.

The bracket 331 may be coupled to the cover housing 320.

The bracket 331 may extend in the longitudinal direction of the light source module 300. The bracket 331 may extend along the light source bracket supporting body 342. The bracket 331 may extend along the longer side of the transparent member 350.

The bracket 331 may be substantially in a shape of a rectangular parallelepiped.

A cavity may be defined in an inner side of the bracket 331. The cavity formed in the inner side of the light source bracket 341 may extend along the longitudinal direction of the light source bracket 341. Accordingly, the light source module 300 may have a light weight. The light source module 300 having a light weight may be easily serviced. Also, a manufacturing cost of the light source module 300 may be reduced.

The light source bracket 341 may have a shape extending to the inner side of the light source module 300. Accordingly, a shape that is coupled to the housing 100 may be provided.

A lower portion of the light source bracket 341 may have a shape extending outward from the light source module 300. Accordingly, a shape to which the cover housing 320 is coupled may be provided.

The light source bracket 341 may include a metal material, although not limited thereto.

The light source bracket 341 may be formed by a drawing process, although not limited thereto.

The light source supporting unit 340 may be adjacent to the light diffuser 360. The light source supporting unit 340 may be positioned in the front or rear portion of the light diffuser 360. The light source supporting unit 340 of the first light source module 300*a* may be positioned in the rear portion of the light diffuser 360. The light source supporting unit 340 of the second light source module 300*b* may be positioned in the front portion of the light diffuser 360.

The light source supporting unit 340 may support the light diffuser 360. The light source supporting unit 340 may guide a location of the light diffuser 360. The light source supporting unit 340 may fix the location of the light diffuser 360 by contacting the light diffuser 360.

The light source supporting unit 340 may be positioned on the transparent member 350. The light source supporting unit 340 may be positioned on the transparent member 350 while being in contact with the transparent member 350. The light source supporting unit 340 may be supported by the transparent member 350.

The light source supporting unit 340 may extend along an extension direction of the light source module 300. The light source supporting unit 340 may extend in the left-right direction.

The light source supporting unit 340 may reinforce strength of the light source module 300.

By positioning the light source supporting unit 340 and the bracket supporting unit 330 in the front-rear direction and positioning the light diffuser 360 below the light source supporting unit 340 and the bracket supporting unit 330, the light diffusing space 360S may be defined. The light diffusing space 360S may be a space through which illumination light L1 passes, as described above.

The light source supporting unit 340 may include the light source bracket supporting body 342. The light source bracket supporting body 342 may be a component supporting the light source supporting unit 340.

The light source bracket supporting body 342 may be positioned on the transparent member 350. The light source bracket supporting body 342 may be supported by the transparent member 350.

The light source bracket supporting body 342 may be positioned in the inner side of the light source module 300.

The light source bracket supporting body 342 may extend in a longitudinal direction. The light source bracket supporting body 342 may extend along the longitudinal direction of the light source module 300. The light source bracket supporting body 342 may extend along the longer side of the transparent member 350.

The light source bracket supporting body 342 may be in contact with light diffuser 360.

The light source bracket supporting body 342 may be a metal material, although not limited thereto.

The light source bracket supporting body 342 may be formed by a drawing process, although not limited thereto.

The light source bracket supporting body 342 may be coupled to the cover housing 320.

The light source supporting unit 340 may include the light source bracket 341. The light source bracket 341 may be a component corresponding to the frame of the light source module 300.

The light source bracket 341 may be positioned on the transparent member 350. The light source bracket 341 may reinforce strength of the light source unit 200 together with the light source bracket supporting body 342.

The light source bracket 341 may extend in the longitudinal direction of the light source module 300. The light source bracket 341 may extend along the longer side of the transparent member 350.

The light source bracket 341 may have a shape of a bent plate.

The light source bracket 341 may include a metal material, although not limited thereto. The light source bracket 341 may have a material capable of reflecting light. Accordingly, guide light L2 may be reflected from a surface of the light source bracket 341.

The light source bracket 341 may be formed by a drawing process, although not limited thereto.

The light source supporting unit 340 may include the light source bracket supporting body 342. The light source bracket supporting body 342 may be a component supporting the light source bracket 341.

The light source bracket supporting body 342 may extend in the longitudinal direction of the light source module 300.

The light source bracket supporting body 342 may be coupled to the light source module 300 at an outer side of the light source bracket 341. The light source bracket supporting body 342 may support the light source bracket 341. The light source bracket supporting body 342 may reinforce strength of the light source bracket 341.

The light source bracket supporting body 342 may be in a shape of a rectangular parallelepiped.

A cavity may be formed in an inner side of the light source bracket supporting body 342. The cavity may extend along the longitudinal direction of the light source bracket supporting body 342. Accordingly, the light source bracket supporting body 342 may be made of a small amount of material. Also, a weight of the light source module 300 may be reduced. The light source module 300 having a light weight may be easily serviced.

The light source module 300 may include a bracket connecting body 333. The bracket connecting body 333 may be a component for connecting the bracket supporting unit 330 with the light source supporting unit 340.

The bracket connecting body 333 may be positioned between the bracket 331 and the light source bracket 341. The bracket connecting body 333 may be coupled to the bracket 331 and the light source bracket 341. Accordingly, the bracket 331 and the light source bracket 341 may be supported. Coupling between the bracket 331 and the light source bracket 341 may be reinforced.

The bracket connecting body 333 may be positioned in a side of the light source module 300.

A pair of bracket connecting bodies 333 may be provided. The pair of bracket connecting bodies 333 may be respectively positioned at both sides of the light source module 300. Accordingly, the bracket 331 may be coupled to the light source bracket 341 without any moment of rotation.

The bracket 331 may be spaced from the light diffuser 360. The bracket 331 may be positioned on the light diffuser 360. Accordingly, the light diffuser 360 may be separable from the light source module 300.

The bracket connecting body 333 may be in a shape of a rectangular parallelepiped.

The bracket connecting body 333 may include a metal material, although not limited thereto.

The bracket connecting body 333 may be formed by casting, although not limited thereto.

The light source module 300 may include the guide light source 310. The guide light source 310 may be a component capable of emitting guide light L2.

The guide light source 310 may be a light emitting diode (LED).

The guide light source 310 may emit guide light L2 in the first direction D1. The guide light source 310 may emit the guide light L2 downward.

The guide light source 310 may be spaced from the transparent member 350.

The light source module 300 may include a guide light source substrate 311. The guide light source substrate 311 may be a component supporting the guide light source 310.

The guide light source substrate 311 may support the guide light source 310.

The guide light source substrate 311 may be in a shape of a rectangular parallelepiped. The guide light source substrate 311 may have a flat surface facing the first direction D1.

The guide light source substrate 311 may extend along the longitudinal direction of the light source module 300.

The light source module 300 may include a guide diffuser 370 as a light guide member. The guide diffuser 370 may be a component for guiding guide light L2. In an embodiment, the light guide member faces the transparent member 350, and the guide light L2 which is emitted by the light guide member passes through the transparent member 350, to the front side of the cooktop 2.

The guide diffuser 370 may support the guide light source substrate 311. The guide diffuser 370 may be in contact with the guide light source substrate 311.

The guide diffuser 370 may be in contact with the transparent member 350.

The guide diffuser 370 may extend along the first direction D1. The guide diffuser 370 may extend along the up-down direction.

The guide diffuser 370 may be positioned between a guide diffusion substrate and the transparent member 350.

The guide diffuser 370 may support the guide diffusion substrate positioned thereon, while being in contact with one end of the transparent member 350.

The guide diffuser 370 may have a shape extending in the first direction D1 from one side of the guide light source 310 and bent toward the transparent member 350. A portion of the guide diffuser 370, extending toward the transparent member 350, may be positioned on a portion of the guide light source 310 toward the first direction D1.

The guide diffuser 370 may reflect guide light L2 to cause the guide light L2 to travel toward the transparent member 350.

The guide diffuser 370 may substantially function as a prism. Guide light L2 may enter inside of the guide diffuser 370, be reflected from one surface of the guide diffuser 370, and then travel toward the transparent member 350.

The guide diffuser 370 may reflect guide light L2 in the second direction D2.

The guide diffuser 370 may face the transparent member 350 such that guide light L2 passes along and through the transparent member 350 and is emitted.

The light source module 300 may include a guide light source fixing body 312. The guide light source fixing body 312 may be a component for fixing the guide light source substrate 311.

The guide light source fixing body 312 may be in contact with the guide light source substrate 311. The guide light source fixing body 312 may support the guide light source substrate 311 in the opposite direction of the first direction D1. The guide light source fixing body 312 may be positioned above the guide light source substrate 311.

The guide light source fixing body 312 may be coupled to the light source bracket supporting body 342. A front or rear portion of the guide light source fixing body 312 may be coupled to the light source bracket supporting body 342.

The guide light source fixing body 312 may be coupled to the guide light source substrate 311.

The guide light source fixing body 312 may be a metal material, although not limited thereto. The guide light source fixing body 312 may include a material capable of reflecting light.

The light source module 300 may include the cover member 380. The cover member 380 may be a component that defines at least one portion of a lower outer appearance of the light source module 300.

The cover member 380 may be coupled to a portion of the guide diffuser 370 toward the opposite direction of the first direction D1.

The cover member 380 may extend in the first direction D1 at a portion being in contact with the guide diffuser 370, be bent, and extend at a side of the transparent member 350 toward the first direction D1 along the second direction D2.

The cover member 380 may extend along the longitudinal direction of the light source module 300.

The cover member 380 may include a metal material, although not limited thereto.

The cover member 380 may be formed by a drawing process.

The light source module 300, which is positioned at the accommodation location, may be adjacent to the module supporting portion 413 to provide an aesthetic sense of unity with the module supporting portion 413.

The cover member 380 may cover at least one portion of the transparent member 350 toward an opposite direction of the sliding direction D3 of the transparent member 350.

A more detailed description will be provided with reference to FIG. 12. A case in which the light source module 300 is the first light source module 300*a* will be assumed and described. A case in which the light source module 300 is the second light source module 300*b* will be understood by changing the front direction to the rear direction and vice versa in the following description.

The light source module 300 may include the transparent member 350. The transparent member 350 may be in a shape of a plate.

The light source module 300 may include the light diffuser 360. The light diffuser 360 may be positioned on the transparent member 350. The light diffuser 360 may be in a shape of a plate. The light diffuser 360 may be put on the transparent member 350. The light diffuser 360 may be positioned on the transparent member 350.

The light diffuser 360 may be attached to the transparent member 350 without any adhesive. An illumination member may be supported by the transparent member 350. Accordingly, the light diffuser 360 may be separated from the transparent member 350. Accordingly, the light diffuser 360 may be easily replaced.

The light source module 300 may include the bracket supporting body 332. The bracket supporting body 332 may be positioned on the transparent member 350. The bracket supporting body 332 may be positioned in the front portion of the light diffuser 360.

The bracket supporting body 332 may be guided such that the light diffuser 360 is coupled to the bracket supporting body 332. The bracket supporting body 332 may guide a coupling location of the light diffuser light diffuser 360. The bracket supporting body 332 may be spaced from the light source bracket 341 such that the light diffuser 360 is positioned between the bracket supporting body 332 and the light source bracket 341. The light diffuser 360 may be positioned between the bracket supporting body 332 and the light source bracket 341. A separation distance between the bracket supporting body 332 and the light source bracket 341 may correspond to a width of the light diffuser 360.

The bracket supporting body 332 may be substantially in a shape of a plate. The bracket supporting body 332 may support the bracket 331 which will be described below.

The light source module 300 may include the bracket 331. The bracket 331 may be positioned on the bracket supporting body 332. The bracket 331 may be positioned on the bracket supporting body 332. The bracket 331 may be in contact with the bracket supporting body 332.

The bracket 331 may fix the cover housing 320 which will be described below.

The bracket 331 may cover an upper portion of the light source module 300 to prevent oil mist from entering the upper portion of the light source module 300.

The light source module 300 may include the cover housing 320. The cover housing 320 may define a front outer appearance of the light source module 300.

A front surface of the cover housing 320 may be perpendicular to a ground or to the cooktop 2.

The cover housing 320 may have a shape protruding in the rear direction. The shape protruding in the rear direction may be coupled to the bracket 331.

A control panel 391 (see FIG. 15) may be positioned on the cover housing 320.

The light source module 300 may include the cover member 380. The cover member 380 may define at least one portion of an outer appearance of the light source module 300 toward the cooktop 2.

The cover member 380 may cover at least one part of a rear portion of the transparent member 350. The cover member 380 may cover at least one part of the rear portion of the light source module 300.

The cover member 380 may cover at least one part of a lower portion of the transparent member 350. The cover member 380 may cover at least one part of a lower, rear portion of the transparent member 350.

The light source module 300 may include the bracket connecting body 333. The bracket connecting body 333 may connect the bracket 331 with the light source bracket 341 which will be described below.

The light source module 300 may have the light diffusing space 360S thereinside. An opening may be defined at an upper side of the light diffusing space 360S. That is, the light diffusing space 360S may be open in a direction opposite to the first direction D1. A lower side of the light diffusing space 360S may be covered by the transparent member 350 or the light diffuser 360. Since the light diffusing space 360S is defined in the light source module 300, a bending moment may be generated with respect to the opening by the light diffusing space 360S. Alternatively, strength of the light source module 300 may be weakened by the light diffusing space 360S.

Components positioned in front of the light diffusing space 360S of the light source module 300 may be coupled to and supported on components positioned behind the light diffusing space 360S by the bracket connecting body 333. The bracket connecting body 333 may reinforce strength of the light source module 300.

A plurality of bracket connecting bodies 333 may be provided. Two bracket connecting bodies 333 may be positioned respectively at left and right sides of the light source module 300. In this case, the bracket connecting bodies 333 may reinforce strength of the light source module 300 at the left and right sides.

Referring to FIG. 13, the following components will be described in detail.

The light diffuser 360 may be provided on the transparent member 350. The light diffuser 360 may be positioned between the light source bracket 341 and the bracket 331 described above. The light diffuser 360 may be a component for diffusing light.

The light source bracket supporting body 342 may be positioned behind the light source bracket 341. The light source bracket supporting body 342 may support the light source bracket 341 from behind.

The guide light source fixing body 312 which will be described below may be fixed to the light source bracket supporting body 342.

A guide diffusing space 370S as a space in which guide light is diffused may be defined between the light source bracket supporting body 342 and the guide diffuser 370. The light source bracket supporting body 342 may be positioned in front of the guide diffusing space 370S, and the guide diffuser 370 may be positioned behind the guide diffusing space 370S. In an embodiment, the light source device Y may further include the guide light source 310 spaced apart from the light guide member, and a guide diffusing space 370S defined between the guide light source 310 and the light guide member. A sidewall (e.g., portion of the light source supporting unit 340 such as the light source bracket 341) may be between the guide light source 310 and the illumination light source 210, along the second direction D2, and the guide diffusing space 370S may be further defined with the sidewall.

The guide diffuser 370 may be provided behind the light source bracket supporting body 342. The guide diffuser 370 may be positioned behind the transparent member 350. The guide diffuser 370 may be positioned behind the transparent member 350, the light source bracket supporting body 342, and the light source bracket 341.

The guide diffusing space 370S may be defined by being surrounded by the transparent member 350, the light source bracket supporting body 342, the light source bracket 341, and the guide diffuser 370, which will be described below. The guide diffusing space 370S may be a space through which guide light L2 travels.

At least one portion of the guide diffuser 370 may be spaced from the guide light source 310 such that the guide diffusing space 370S is defined between the guide diffuser 370 and the guide light source 310.

The light source supporting unit 340 may be positioned in the second direction D2 from the guide light source 310 such that the guide diffusing space 370S is defined between the light source supporting unit 340 and the guide diffuser 370.

A surface of the light source bracket supporting body 342 or the light source bracket 341, facing the guide diffusing space 370S, may reflect light. Light traveling through the guide diffusing space 370S to arrive at the light source bracket supporting body 342 or the light source bracket 341 may be reflected and move toward the guide That is, the light source supporting unit 340 may have an indirect reflection surface 341A facing the guide diffusing space 370S to reflect the guide light L2.

Above the guide diffuser 370, the guide light source substrate 311 may be positioned to locate the guide light source 310 therebelow. A lower side of the guide light source substrate 311 may be supported by the guide diffuser 370.

The guide diffusing space 370S may be defined below the guide diffuser 370.

The guide light source 310 may emit guide light L2 downward. The guide light L2 may move toward the guide diffusing space 370S. The guide diffuser 370 may be positioned in a lower area of the guide diffusing space 370S. The guide diffuser 370 may reflect guide light L2 in the front direction. The guide light L2 may move toward the front direction of the light source module 300 by passing through the transparent member 350 positioned in front of the guide diffuser 370 (see FIG. 15).

The guide light source fixing body 312 may be positioned on the guide light source substrate 311. The guide light source fixing body 312 may fix the guide light source substrate 311. The guide light source substrate 311 may be prevented from moving by being fixed by the guide light source fixing body 312 from above and supported by the guide diffuser 370 from below.

The guide light source fixing body 312 may fix the guide light source substrate 311 by shrink-fit.

Figure 14:
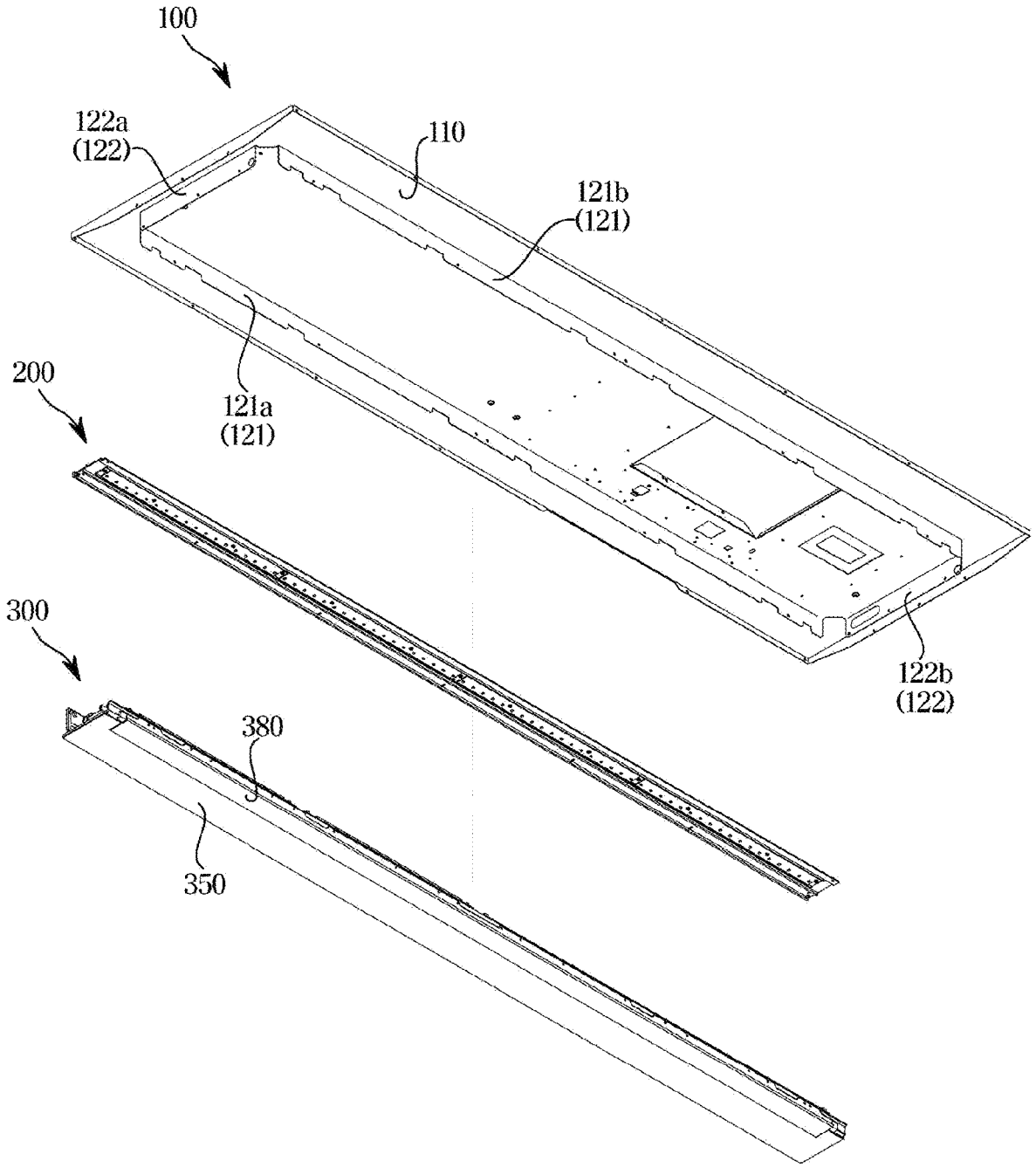
FIG. 14 is a perspective view of a housing, a light source module, and a light source unit of the range hood shown in FIG. 6.

FIG. 14 is a perspective view of the housing 100, the light source module 300, and the light source unit 200 of the range hood 1 shown in FIG. 6.

Referring to FIG. 14, the light source unit 200 according to an embodiment of the disclosure will be described.

The range hood 1 may include the light source unit 200. The light source unit 200 may be a component for emitting light in the first direction D1.

The light source unit 200 may be coupled to the housing 100. The light source unit 200 may be coupled to the housing plate 110. The light source unit 200 may be coupled to the housing plate 110 at a lower portion of the housing plate 110.

The light source unit 200 may emit illumination light L1 toward the first direction D1. The illumination light L1 may travel downward.

The illumination light L1 may travel by passing through the light diffusing space 360S defined in the light source unit 200. The illumination light L1 may travel by passing through the light diffusing space 360S and being transmitted in the first direction D1 through both the light diffuser plate 360 and the transparent member 350.

That is, the transparent member 350 may be spaced in the first direction D1 from the illumination light source 210 to diffuse illumination light L1.

FIG. 15 is a cross-sectional view of the light source device Y of the range hood 1 shown in FIG. 10.

Referring to FIG. 15, a movement of light in the light source device Y will be described.

The light source device Y may include the light source unit 200 in a direction in which the light source device Y is spaced from the cooktop 2 (e.g., along the first direction D1).

The light source device Y may include the light source module 300 closer to the cooktop 2 than the light source unit 200.

The main body X may include the light source device Y.

The light source device Y may include an illumination light source 210 capable of emitting illumination light L1 in the first direction D1 toward the cooktop 2 from the main body X, and a guide light source 310 capable of emitting guide light L2 in the first direction D1 toward the cooktop 2. A direction of the guide light L2 is changed within the light source device Y as describe above.

The guide light source 310 may be controlled separately from the illumination light source 210 to emit light in an emitting direction. Accordingly, the illumination light source 210 may be powered off although guide light L2 is emitted by the guide light source 310.

The second direction D2 may intersect the first direction D1. Accordingly, guide light L2 which is initially emitted in the first direction D1 but emitted from the range hood 1 in the second direction D2, may perform a role that is different from illumination light L1 which is both initially emitted and finally emitted in the first direction D1. That is, the guide light source 310 and the illumination light source 210 may together define a light source (or a plurality of light sources) of the range hood 1.

The guide light source 310 may initially emit guide light L2 in the first direction D1.

The light source unit 200 may include the illumination light source 210. The illumination light source 210 may initially emit illumination light L1. The illumination light source 210 may initially emit illumination light L1 toward the cooktop 2, that is, in the first direction D1. The illumination light source 210 may emit illumination light L1 downward.

The illumination light L1 may pass through the light diffusing space 360S. The illumination light L1 may be diffused while passing through the light diffusing space 360S. In a case in which the illumination light L1 is not diffused, a user may easily recognize the illumination light source 210. In a case in which a user definitely recognizes the illumination light source 210 from outside, an aesthetic sense of the range hood 1 may deteriorate. Light diffused without showing a shape of a light source may be recognized as a surface, not a point, which may improve an aesthetic sense.

That is, illumination light L1 may travel a certain distance until the illumination light L1 is emitted from the illumination light source 210 and escapes the light source module 300.

The light source module 300 may include the light diffuser 360 positioned below the illumination light source 210. The light diffuser 360 may be positioned at the lower side of the light diffusing space 360S. The illumination light L1 may be diffused while passing through the light diffuser 360 in the first direction D1. The light diffuser 360 may have a material that diffuses illumination light L1. The light diffuser 360 may include a translucent material. The light diffuser 360 may have a white color.

The transparent member 350 may be provided below the light diffuser 360. Illumination light L1 passed through the light diffuser 360 may penetrate the transparent member 350. The transparent member 350 may be not a component for diffusing light.

The transparent member 350 may have a transparent material through which light penetrates. Since the transparent member 350 has a transparent color, an aesthetic sense of the range hood 1 may rise. An aesthetic sense may be further improved than in a case in which the transparent member 350 performs a role of diffusing light.

The transparent member 350 may be positioned outside of the light source module 300. The transparent member 350 may have a certain thickness or more to protect components positioned inside the light source device Y. A thickness of the transparent member 350 may be greater than a thickness of the light diffuser 360, where a thickness is defined along the first direction D1.

The transparent member 350 may include a material having smaller strength than the light diffuser 360. The transparent member 350 may protect the components positioned inside the light source device Y against an impact from the outside of the light source device Y.

Illumination light L1 passed through the transparent member 350 in the first direction D1 may continue to travel toward the cooktop 2 along the first direction D1. The illumination light L1 may illuminate a cooking material that is cooked on the cooktop 2 to enable a user to easily cook the cooking material.

A plurality of illumination light sources 210 may be provided. The plurality of illumination light sources 210 may be supported by an illumination light source substrate 211 which will be described below.

A number of the plurality of illumination light sources 210 may change depending on a number of the plurality of guide light sources 310. The reason may be because power used in the light source module 300 is limited. A total number of the plurality of illumination light sources 210 and the plurality of guide light sources 310 may be a preset figure. That is, as the number of the plurality of illumination light sources 210 increases, the number of the plurality of guide light sources 310 may decrease, whereas, as the number of the plurality of illumination light sources 210 decreases, the number of the plurality of guide light sources 310 may increase.

In other words, dividing light sources into the illumination light sources 210 and the guide light sources 310 may be dividing a preset total sum of light sources.

The plurality of illumination light sources 210 may be spaced by equal distances from each other to provide a desired amount of light toward the cooktop 2 regardless of a limited number of illumination light sources 210. The illumination light sources 210 may be arranged along the left-right direction.

The above description may be applied in the same way to the plurality of guide light sources 310.

The light source unit 200 may include the illumination light source substrate 211. The illumination light source substrate 211 may be a component supporting the illumination light source 210.

The illumination light source 210 may be positioned below the illumination light source substrate 211. The illumination light source substrate 211 may be positioned above the light diffusing space 360S. The illumination light source substrate 211 may be spaced from the transparent member 350.

The illumination light source substrate 211 may be in a shape of a plate. The illumination light source substrate 211 may be positioned such that flat surfaces of upper and lower portions have a wider area than a flat surface of a side portion. The illumination light source substrate 211 may be positioned upward or downward. The illumination light source substrate 211 may extend along the light source module 300.

A plurality of illumination light sources 211 may be provided.

The light source unit 200 may include an illumination light source supporting body 230. The illumination light source supporting body 230 may be a component supporting the illumination light source substrate 211.

The illumination light source supporting body 230 may be coupled to the illumination light source substrate 211 above the illumination light source substrate 211.

The illumination light source supporting body 230 may be positioned above the light diffusing space 360S. The illumination light source supporting body 230 may be spaced from the transparent member 350.

The illumination light source supporting body 230 may have a shape corresponding to the illumination light source substrate 211.

The illumination light source supporting body 230 may extend along the illumination light source substrate 211.

The illumination light source supporting body 230 may have a metal material, although not limited thereto.

The illumination light source supporting body 230 may be formed by a drawing process, although not limited thereto.

The light source unit 200 may include an illumination light source bracket 220. The illumination light source bracket 220 may be a component for fixing the illumination light source substrate 211 or the illumination light source supporting body 230 to the housing 100.

The illumination light source bracket 220 may be coupled to the illumination light source supporting body 230 above the illumination light source supporting body 230.

The illumination light source bracket 220 may be coupled to the housing 100. That is, a light source of the illumination light L1 may refer to a collection of the above features 210, 211, 220 and 230 together with each other. Such light source may be coupled to the housing 100 at the illumination light source bracket 220, as shown in FIG. 15. Accordingly, the illumination light source supporting body 230 and the illumination light source substrate 211 may be coupled to the housing 100.

The illumination light source bracket 220 may be positioned above the light diffusing space 360S. The illumination light source bracket 220 may be spaced from the transparent member 350.

The illumination light source bracket 220 may have a shape corresponding to the illumination light source substrate 211.

The illumination light source bracket 220 may extend along the light source module 300.

The illumination light source bracket 220 may have a metal material, although not limited thereto.

The illumination light source bracket 220 may be formed by a drawing process, although not limited thereto.

A surface of the illumination light source supporting body 230, facing the light diffusing space 360S, may have a wider area than a surface of the illumination light source substrate 211, facing the light diffusing space 360S. A surface of the illumination light source bracket 220, facing the light diffusing space 360S, may have a wider area than a surface of the illumination light source substrate 211, facing the light diffusing space 360S.

A part of the surface of the illumination light source supporting body 230, facing the light diffusing space 360S together with a part of the surface of the illumination light source bracket 220, facing the light diffusing space 360S, may surround the light diffusing space 360S.

The surface of the illumination light source supporting body 230, facing the light diffusing space 360S and the surface of the illumination light source bracket 220, facing the light diffusing space 360S may reflect light. Accordingly, light moving upward may be reflected and move toward the cooktop 2.

The light source module 300 may include the control panel 391. The control panel 391 may perform a function of enabling a user to input a user input, a function of displaying a current status or state of the range hood 1, a function of displaying an environment of a kitchen, etc.

The control panel 391 may be provided on the cover housing 320.

The light source module 300 may include a control box 390. The control box 390 may be a component including electronic parts related to the control panel 391.

The control box 390 may be positioned inside the light source module 300. The control box 390 may be positioned behind the control panel 391.

The light source module 300 may include the guide light source 310.

The guide light source 310 may be a separate light source (e.g., a second light source) that is different from the illumination light source 210 as a first light source within the light source device Y. The guide light source 310 may be controlled independently from the illumination light source 210. For example, the guide light source 310 may emit guide light L2, and the illumination light source 210 may not emit illumination light L1. That is, emission of the guide light L2 by the guide light source 310 is independent from emission of the illumination light L1 by the illumination light source 210. For example, the guide light source 310 and the illumination light source 210 may emit light having different colors from each other. That is, a color of the guide light L2 which is emitted to the front side of the cooktop 2 is different from a color of the illumination light L1 which is emitted to the cooktop 2. A pattern in which a guide light source 310 emits light may be different from a pattern in which the illumination light source 210 emits illumination light L1. As used herein, a pattern may refer to the planar shape formed by the emitted light, where the planar shape may be displayed at a surface.

The guide light source 310 may emit guide light L2. An initial emission direction of the guide light L2 from the guide light source 310 may be a same direction as an initial emission direction of the illumination light L1 from the illumination light source 210, that is, in the first direction D1.

The guide light L2 may initially pass through the guide diffusing space 370S. The guide light L2 may move toward the guide diffuser 370 positioned at one side of the guide diffusing space 370S.

The guide light L2 passed through the guide diffusing space 370S may next be incident into and pass through the guide diffuser 370. The guide light L2 may be reflected or refracted at the inside of the guide diffuser 370 and a traveling path of the guide light L2 may change within the guide diffuser 370.

A path of the guide light L2 may change such that the guide light L2 initially emitted in the first direction D1 moves toward the transparent member 350 in the second direction D2 by the guide diffuser 370. An index of refraction of the guide diffuser 370 may be greater than an index of refraction of air. Accordingly, guide light L2 entered the guide diffuser 370 may move along an extension direction of the guide The cover member 380 may be provided below the guide diffuser 370. Although a part of the guide light L2 moves downward, the guide light L2 may be blocked by the cover member 380. Accordingly, the guide light L2 may be prevented from moving toward the cooktop 2 via the cover member 380.

A side of the cover member 380, facing the guide diffuser 370, may reflect light. Accordingly, guide light L2 traveling from the guide diffuser 370 to the cover member 380 may be reflected by the cover member 380 and move toward the guide diffuser 370 or the transparent member 350.

The cover member 380 may cover a lower or rear portion of the guide diffuser 370. Guide light L2 moving toward a rear of the guide diffuser 370 may be blocked by the cover member 380. Accordingly, the guide light L2 may be prevented from being emitted to the inside of the range hood 1.

The guide light L2 may move in the front direction (e.g., in the second direction D2) along and within the transparent member 350. Since the transparent member 350 has a greater index of refraction than air, guide light L2 passed through the transparent member 350 may have difficulties in moving toward outside air of the transparent member 350. The guide light L2 may move toward the front direction by the transparent member 350.

The transparent member 350 may pass through the cover housing 320 and extend further than a front surface of the cover housing 320, in the front direction. In a case in which the transparent member 350 does not extend further from the cover housing 320 in the front direction, guide light L2 may pass through the transparent member 350 and then move toward the cover housing 320. In this case, because guide light L2 is shown like being illuminated to the cover housing 320 and the transparent member 350 from outside the range hood 1, an aesthetic sense may deteriorate. Since the transparent member 350 passes through the cover housing 320 and extends in the front direction, guide light L2 may be shown as being emitted only from the transparent member 350 as the range hood 1 is shown from outside the range hood 1. Accordingly, the range hood 1 with an improved aesthetic sense may be provided.

A direction in which guide light L2 escapes the range hood 1 (e.g., a final emission direction) may intersect a direction in which illumination light L1 escapes the range hood 1. The guide light L2 may escape the range hood 1 in a direction that is different from a direction of the illumination light L1 by the above-mentioned component for guiding light. Since a final emission direction of the guide light L2 is different from a final emission direction of the illumination light L1, the guide light L2 may perform a function that is different from a function of the illumination light L1.

The light source module 300 may include the guide diffuser 370.

The guide diffuser 370 may include a substrate supporting portion 371. The substrate supporting portion 371 may be a component supporting the guide light source substrate 311.

In an embodiment, the light source device Y may include the guide light source substrate 311 from which the guide light source 310 protrudes, and the light guide member may include the substrate supporting portion 371 on which the guide light source substrate 311 is supported.

The substrate supporting portion 371 may support the guide light source substrate 311.

The substrate supporting portion 371 may be positioned to a side of the guide light source 310. Referring to FIG. 15, for example, the substrate supporting portion 371 may be coplanar with the guide light source 310.

The substrate supporting portion 371 may extend to be parallel to the guide light source substrate 311. The guide light source substrate 311 may extend in the left-right direction. The substrate supporting portion 371 may extend in the left-right direction.

The substrate supporting portion 371 may be supported by the cover member 380. The substrate supporting portion 371 may be in contact with the cover member 380.

One surface of the substrate supporting portion 371 may be positioned toward the guide light source substrate 311, and the other surface of the substrate supporting portion 371, which is opposite to the one surface, may be positioned toward the cover member 380.

The guide light source 310 may be positioned in front of the substrate supporting portion 371.

The guide diffuser 370 may include a prism portion 373. The prism portion 373 may be a component for changing a path of the guide light L2.

The prism portion 373 may be positioned on a traveling path of the guide light L2. The prism portion 373 may be positioned below the guide light source 310. The prism portion 373 may be positioned below the guide diffusing space 370S.

The prism portion 373 may be configured such that guide light L2 is transmitted through inside of the prism portion 373 and reflected from an inclined surface 373A inclined with respect to the first direction D1 and the second direction D2. In an embodiment, the guide light L2 which is emitted by the light guide source 310 in the first direction D1 transmits through the light guide member and is reflected at the inclined surface 373A of the light guide member, to be emitted by the light guide member in the second direction D2, to the front side of the cooktop 2.

The prism portion 373 may extend along an extension direction of the light source module 300. The prism portion 373 may extend in the left-right direction.

A cross section of the prism portion 373 may be a right-angled triangle.

The prism portion 373 may include a flat surface facing the guide light source 310, on a side toward the guide light source 310. The flat surface facing the guide light source 310 may extend in a direction that is perpendicular to a traveling direction of guide light L2. Accordingly, guide light L2 may face the flat surface of the prism portion 373 that is perpendicular to the traveling direction. The flat surface of the prism portion 373, positioned toward the guide light source 310, may be a flat surface facing upward or a flat surface being parallel to the ground.

Guide light L2 may pass through inside air of the guide diffusing space 370S and enter the prism portion 373 having a greater index of refraction than air. In this case, because the guide light L2 meets a surface being perpendicular to the traveling direction, the guide light L2 may enter the inside of the prism portion 373 without being refracted. The guide light L2 may enter the prism portion 373 without being refracted, and accordingly, the guide light L2 may be not dispersed. Since the guide light L2 is not dispersed, the guide light L2 escaping the light source module 300 may show a color not dispersed. Accordingly, the guide light L2 may appear in desired color.

The prism portion 373 may include a flat surface facing the transparent member 350, on a side toward the transparent member 350. The flat surface facing the transparent member 350 may extend in a direction that is perpendicular to a traveling direction of guide light L2 escaping the prism portion 373. The flat surface of the prism portion 373, positioned toward the transparent member 350, may be a flat surface facing the front direction or a flat surface being perpendicular to the ground.

Accordingly, guide light L2 may face the flat surface of the prism portion 373, which is perpendicular to the traveling direction of the guide light L2. Due to the same reason described above, guide light L2 may be prevented from being dispersed by escaping the prism portion 373.

The prism portion 373 may have an inclined surface 373A for changing a traveling direction of guide light L2, such as from the initial emission direction to the final emission direction. The inclined surface 373A may be positioned between a surface of the prism portion 373, being a side of the prism portion 373 toward the guide light source 310, and a surface of the prism portion 373, being a side of the prism portion 373 toward the transparent member 350.

The inclined surface 373A may extend in the left-right direction. The inclined surface 373A may be inclined at about 45 degrees with respect to the ground or to a plane defined by the second direction D2 and the third direction (e.g., a direction in to the view of FIG. 15, for example). Accordingly, guide light L2 initially emitted downward from the guide light source 310 may be reflected from the inclined surface 373A and finally emitted in the front direction (e.g., the second direction D2). That is, the guide light L2 may have an initial emission direction from the guide light source 310 which is different from a final emission direction from the range hood 1.

The guide diffuser 370 may include a connecting portion 372. The connecting portion 372 may be a component connecting the prism portion 373 with the substrate supporting portion 371. That is, the light guide member may further include the connecting portion 372 which connects the substrate supporting portion 371 to the inclined surface 373A and guides the guide light L2 from the guide light source 310 to the inclined surface 373A.

The connecting portion 372 may be coupled to the substrate supporting portion 371 from below the substrate supporting portion 371.

The connecting portion 372 may extend from the substrate supporting portion 371 to the prism portion 373 to guide the guide light L2 emitted from the guide light source 310 to the prism portion 373.

The connecting portion 372 may be coupled to the prism portion 373 from above the prism portion 373.

The connecting portion 372 may extend in the up-down direction. Accordingly, although the guide light L2 moves toward the connecting portion 372 without moving straight toward the prism portion 373, the guide light L2 may move to the prism portion 373 through the connecting portion 372.

A rear portion of the connecting portion 372 may be supported by the cover member 380.

Additionally, a location of the light diffuser 360 may be guided.

The light diffuser 360 may include a diffusing plate guide portion 361. The diffusing plate guide portion 361 may be a component for easily guiding a location of the light diffuser 360.

A location of the light diffuser 360 may be guided by the bracket supporting unit 330 positioned in front of the light diffuser 360 and the light source supporting unit 340 positioned behind the light diffuser 360.

The diffusing plate guide portion 361 may be in contact with the bracket supporting unit 330 or the light source supporting unit 340.

The diffusing plate guide portion 361 may be bent in a direction of being away from the transparent member 350.

The diffusing plate guide portion 361 may be bent in an opposite direction of the first direction D1 to be in contact with the bracket supporting unit 330 or the light source supporting unit 340. Accordingly, an area of the diffusing plate guide portion 361, which is in contact with the bracket supporting unit 330 or the light source supporting unit 340, may be widened.

Figure 16:
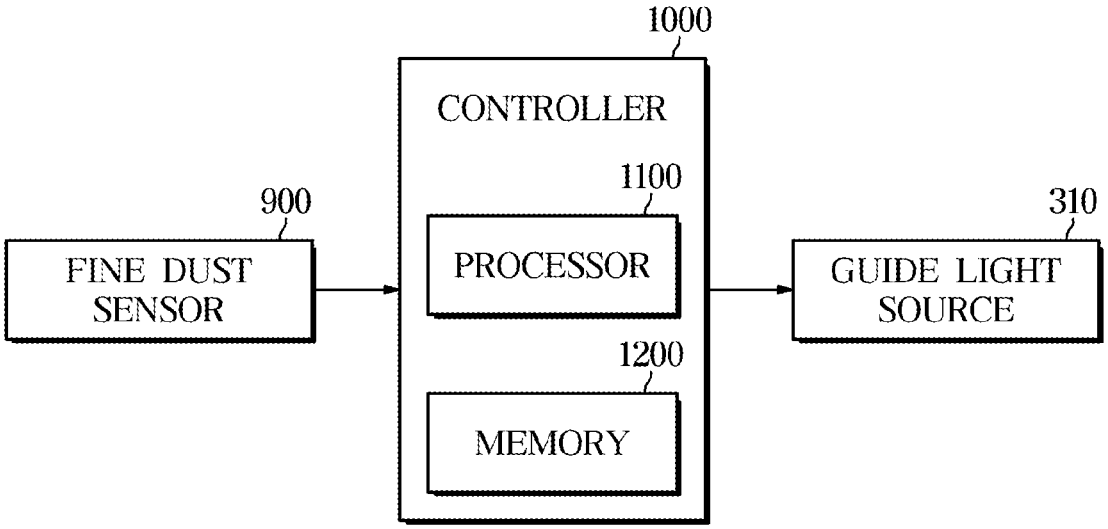
FIG. 16 is a control block diagram of a sensor of the range hood shown in FIG. 1.

FIG. 16 is a control block diagram of a sensor of the range hood 1 shown in FIG. 1.

Referring to FIG. 16, a fine dust sensor 900 according to an embodiment of the disclosure will be described.

The range hood 1 may include the fine dust sensor 900. The fine dust sensor 900 may be a component for outputting a signal (e.g., an electrical signal, a audible signal, a visual signal, etc.) in correspondence to a concentration of fine dust.

The fine dust sensor 900 may output a signal according to a concentration of fine dust.

The range hood 1 may include a controller 1000. The controller 1000 may include a processor 1100 and a memory 1200.

The processor 1100 may be electrically connected with the fine dust sensor 900.

The memory 1200 may store or memorize a program (a plurality of instructions) or data for processing a signal and providing a control signal. The memory 1200 may include a volatile memory 1200, such as Static Random Access Memory (S-RAM) and Dynamic Random Access Memory (D-RAM), and a non-volatile memory 1200, such as Read Only Memory (ROM) and Erasable Programmable Read Only Memory (EPROM). The memory 1200 may be integrated into the processor 1100 and provided as a semiconductor device separated from the processor 1100.

Also, an external memory may be provided outside the processor 1100.

The processor 1100 may further include a processing core (for example, an arithmetic circuit, a memory circuit, and a control circuit) for processing a signal and outputting a control signal based on a program or data stored in the memory 1200.

The processor 1100 may identify a concentration of fine dust based on a signal output from the fine dust sensor 900. The processor 1100 may control the guide light source 310 based on an identified concentration of fine dust. The processor 1100 may control the guide light source 310 to enable a user to identify a concentration of fine dust through the guide light source 310.

That is, the processor 1100 may control a color of guide light L2 through the guide light source 310 based on a signal output from the fine dust sensor 900 which has measured fine dust that is greater than or equal to a preset value.

However, the processor 1100 may control the guide light source 310 based on another signal, as well as the fine dust sensor 900.

For example, upon overheating of the cooktop 2, the processor 1100 may control the guide light source 310 to inform a user of the overheating of the cooktop 2.

That is, the guide light source 310 may be controlled independently from illumination light source 210, by control of the controller 1000 connected to the various light sources. In an embodiment, emission of the guide light L2 by the guide light source 310 is controlled independently from emission of the illumination light L1 by the illumination light source 210, by control of the controller 1000, sensing of the sensor 900, etc.

The guide light source 310 may emit guide light L2 having a color that is different from a color of illumination light L1 emitted from the illumination light source 210. Accordingly, a user may easily identify that the guide light source 310 displays information that is different from the illumination light source 210.

Figure 17:
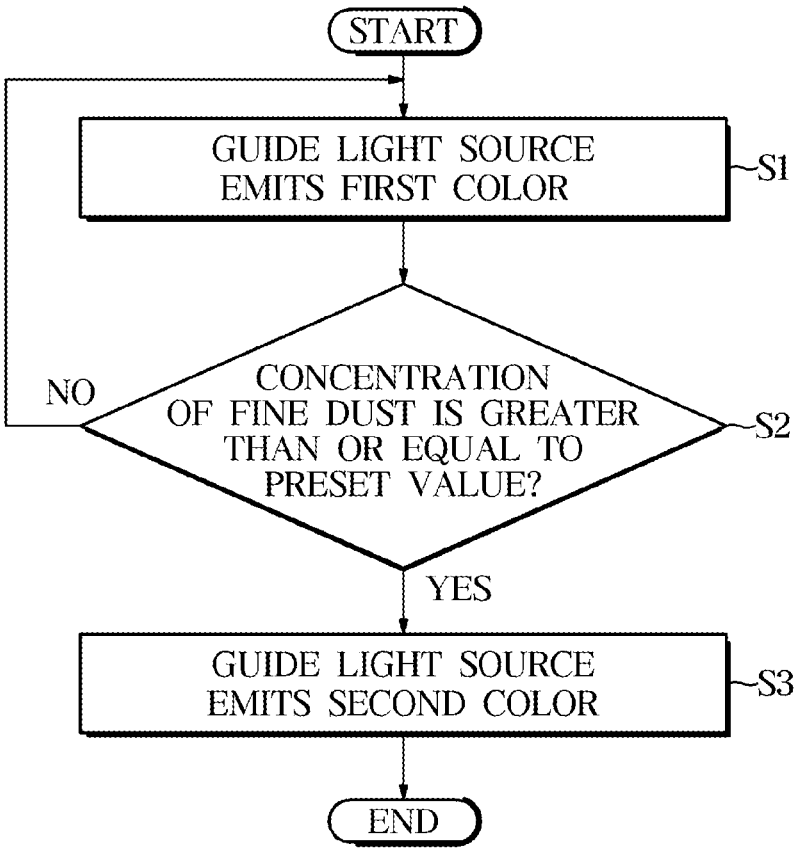
FIG. 17 is a flowchart showing a sensing method by a fine dust sensor of the range hood shown in FIG. 16.
Figure 18:
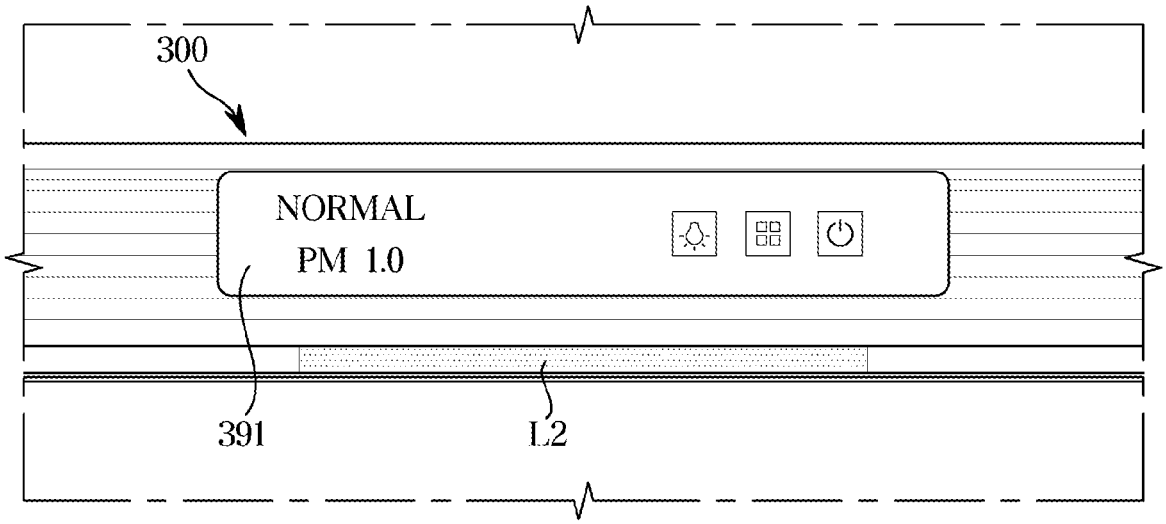
FIG. 18 is a conceptual view showing a state in which the fine dust sensor of the range hood shown in FIG. 17 detects no fine dust.
Figure 19:
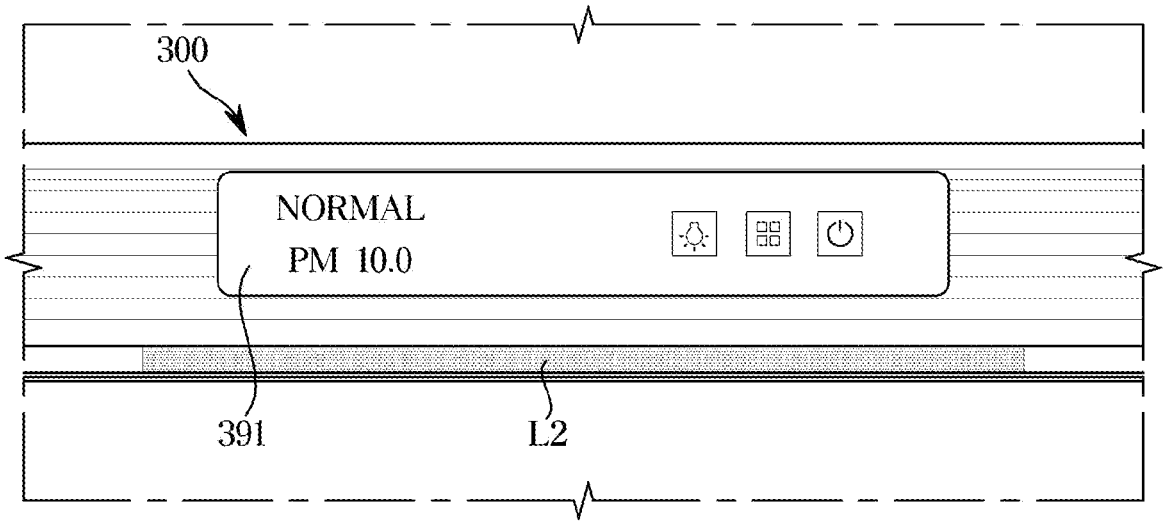
FIG. 19 is a conceptual view showing a state in which the fine dust sensor of the range hood shown in FIG. 18 detects fine dust.

The components of FIG. 16 may be variously connected to the range hood 1 and/or the cooktop 2 to provide the above-described functions. For example, the controller 1000 may be connected to the light source device Y to independently control the FIG. 17 is a flowchart showing a sensing method by the fine dust sensor 900 of the range hood 1 shown in FIG. 16. FIG. 18 is a conceptual view showing a state in which the fine dust sensor 900 of the range hood 1 shown in FIG. 17 detects no fine dust. FIG. 19 is a conceptual view showing a state in which the fine dust sensor 900 of the range hood 1 shown in FIG. 18 detects fine dust.

Referring to FIGS. 17 to 19, a fine dust measuring method according to an embodiment of the disclosure will be described.

The guide light source 310 may finally emit light having a first color from the range hood 1 (S1). A color of the guide light L2 which is emitted from the guide light source 310 may be a color except for a white color. However, a color of the guide light L2 emitted from the guide light source 310 may be a white color. For convenience of description, a color of guide light L2 is assumed to be a color except for a white color. For example, the first color may be a blue color. The first color may be a color for normal operation of the range hood 1 and/or the cooktop 2, without being limited thereto.

Illumination light L1 emitted from the illumination light source 210 may be a white color. Since the illumination light L1 is light for illuminating the cooktop 2, a cooking material may need to be better identified by illumination light L1. Accordingly, illumination light L1 may have a white color or another color that is advantageous to identify objects.

The guide light source 310 may have a purpose for display, that is, provide display light with which an informational display of the range hood 1 is provided. Accordingly, the guide light L2 which is emitted by the range hood 1 may have a color for decorating an outer appearance or definitely identifying a displayed signal (e.g., a status or state of operation of the range hood 1). Accordingly, the guide light L2 which is emitted from the range hood 1 may properly achieve the purpose although the guide light L2 has another color except for a white color. FIG. 18 shows the guide light L2 having a first pattern to represent the first color.

The fine dust sensor 900 may output, after measuring a concentration of fine dust that is higher than or equal to a preset concentration of fine dust, a corresponding signal.

Alternatively, the fine dust sensor 900 may output a signal corresponding to a concentration of fine dust.

The processor 1100 may identify a concentration of fine dust based on a signal output from the fine dust sensor 900. The processor 1100 may determine whether the identified concentration of fine dust is higher than or equal to the preset concentration of fine dust (S2).

For example, the preset concentration of fine dust may be a minimal concentration of fine dust that is harmful to human body.

Upon outputting of a signal corresponding to the preset concentration of fine dust by the fine dust sensor 900, the processor 1100 may identify that a concentration of fine dust is greater than or equal to a preset value, based on the signal output from the fine dust sensor 900.

In a case in which a concentration of fine dust is greater than or equal to the preset value, the processor 1100 may control the guide light source 310 to change a color of guide light L2 emitted from the guide light source 310, to a second color that is different from the first color (S3). For example, the second color of the guide light L2 which is finally emitted from the range hood 1 may be a red color. The second color may be a color for a non-normal operation, a color corresponding to a specific status or state, a color corresponding to a particular function or message display, etc. of the range hood 1 and/or the cooktop 2, without being limited thereto.

A user may identify whether a concentration of indoor fine dust is harmful to human body, through the guide light L2 changed from the first color to the second color and finally emitted by the range hood 1. FIG. 19 shows the guide light L2 having a second pattern to represent the second color which is different from the first color. The planar area of the guide light L2 which is visible from the front side of the range hood 1 may be different, depending upon the finally-emitted color of the guide light L2, based on a status, state or operation of the range hood 1 and/or the cooktop 2, etc.

The user may check the second color of the guide light L2 and then perform an action of ventilating an indoor space or operating an air cleaner.

So far, the range hood 1 according to an embodiment of the disclosure has been described. Hereinafter, another embodiment of the disclosure will be described. In the following description about the embodiment of the disclosure, the same components as those shown in FIGS. 1 to 19 are assigned like reference numerals, and descriptions thereof will be omitted.

Figure 20:
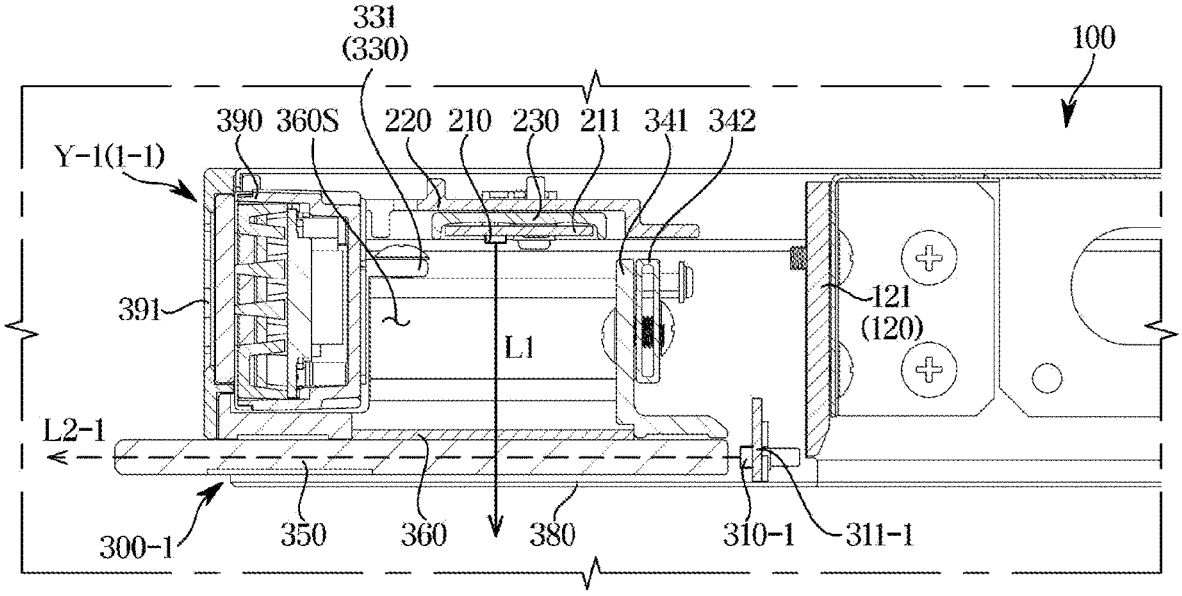
FIG. 20 is a cross-sectional view of a light source device of a range hood according to an embodiment of the disclosure.

FIG. 20 is a cross-sectional view of a light source device Y-1 of a range hood 1-1 according to an embodiment of the disclosure.

Referring to FIG. 20, a light source module 300-1 according to an embodiment of the disclosure will be described.

The light source module 300-1 may include a guide light source 310-1.

The guide light source 310-1 may irradiate light directly toward the transparent member 350. The guide light source 310-1 may irradiate light directly toward the transparent member 350, without passing through the guide diffuser 370 as an intervening member.

The guide light source 310-1 may be positioned behind the transparent member 350. The guide light source 310-1 may initially emit guide light L2-1 toward the front direction from behind the transparent member 350. That is, the guide light L2-1 may have an initial emission direction from the guide light source 310-1 which is the same as a final emission direction from the range hood 1-1.

The guide light source 310-1 may be spaced from the transparent member 350. Referring to FIG. 20, for example, an incident surface of the transparent member 350 (e.g., the right vertical side surfaces) is spaced apart from the emission surface of the guide light source 310-1 (e.g., a left vertical side surface), along the second direction D2. Accordingly, the guide light source 310-1 may diffuse guide light L2-1.

The light source module 300-1 may include a guide light source substrate 311-1.

The guide light source substrate 311-1 may be perpendicular to the transparent member 350, to support the guide light source 310-1.

That is, to diffuse illumination light L1, the light source device Y-1 may include the transparent member 350 that is spaced in the first direction D1 from the illumination light source 210 to define the light diffusing space 360S through which the illumination light L1 passes. In this case, the guide light source 310-1 may be positioned in the opposite direction of the second direction D2 from the transparent member 350, and emit guide light L2-1 in the second direction D2 toward the transparent member 350.

The current embodiment of the disclosure is different from the embodiments described above with reference to FIGS. 1 to 19 in that the guide diffuser 370 is omitted.

Figure 21:
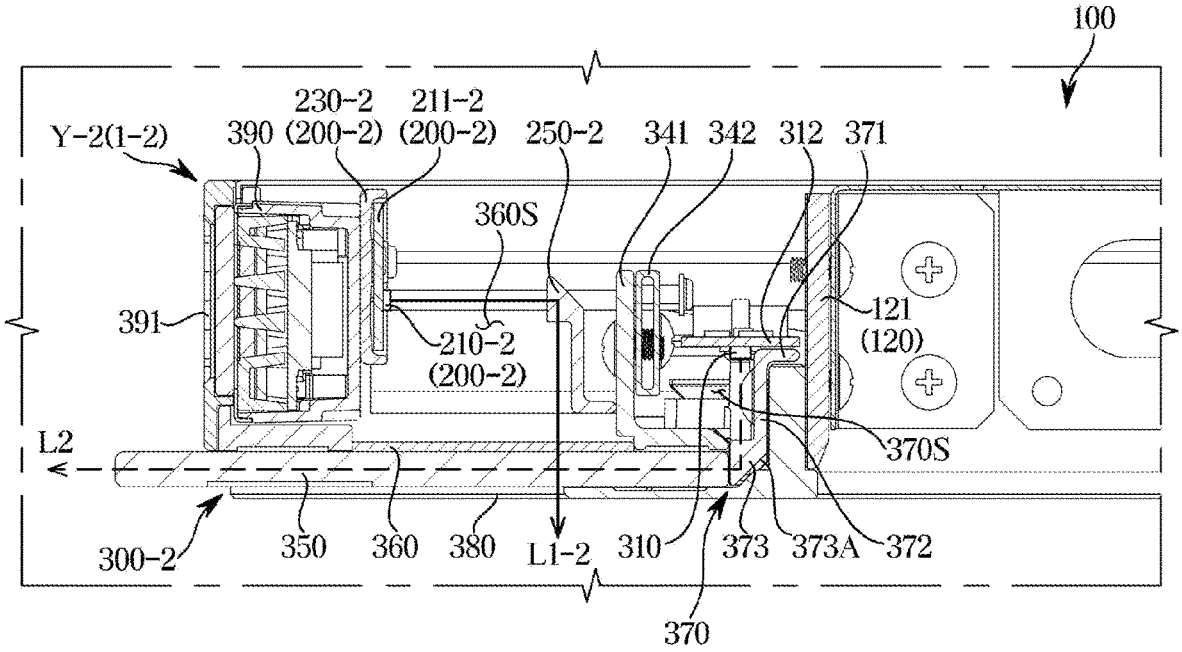
FIG. 21 is a cross-sectional view of a light source device of a range hood according to an embodiment of the disclosure.

FIG. 21 is a cross-sectional view of a light source device Y-2 of a range hood 1-2 according to an embodiment of the disclosure.

Referring to FIG. 21, the light source device Y-2 according to an embodiment of the disclosure will be described.

The light source device Y-2 may include a light source unit 200-2.

The light source unit 200-2 may include an illumination light source 210-2.

The illumination light source 210-2 may emit illumination light L1-2 from front to back, that is, in a direction opposite to the second direction D2, although not limited thereto. However, the illumination light source 210-2 may emit illumination light L1-2 from back to front (e.g., in the second direction D2) or at a certain angle with respect to the first direction D1.

The light source unit 200-2 may include an illumination light source substrate 211-2.

The illumination light source substrate 211-2 may extend in the up-down direction to support the illumination light source 210-2.

The light source unit 200-2 may include an illumination light source supporting body 230-2 and an illumination light source bracket 220-2. The illumination light source supporting body 230-2 and the illumination light source bracket 220-2 may extend in the up-down direction to support the illumination light source substrate 211-2.

Illumination light L1-2 which is initially emitted from the illumination light source 210-2 may travel in a light path direction toward the rear direction of the range hood 1-2. An light path direction of the illumination light L1-2 may be changed such that the illumination light L1-2 travels toward the cooktop 2 positioned therebelow to illuminate the cooktop 2.

The light source module 300-2 may include an illumination guide diffuser 250-2 as a light guide member. The illumination guide diffuser 250-2 may be a component capable of changing a traveling path of illumination light L1-2.

The illumination guide diffuser 250-2 may have a shape corresponding to the guide diffuser 370.

The illumination guide diffuser 250-2 may change a path of light to move illumination light L1-2 moving in the front-rear direction downward.

The illumination guide diffuser 250-2 may be coupled and fixed to the light source bracket 341.

The illumination guide diffuser 250-2 may be spaced in the opposite direction of the second direction D2.

The illumination light source 210-2 may initially emit illumination light L1-2 toward the illumination guide diffuser 250-2.

The illumination guide diffuser 250-2 may reflect illumination light L1-2 which is initially emitted from the illumination light source 210-2 along the second direction D2, in the first direction D1.

The current embodiment of the disclosure is different from the embodiments described above with reference to FIGS. 1 to 19 in view of a path of illumination light L1-1.

Figure 22:
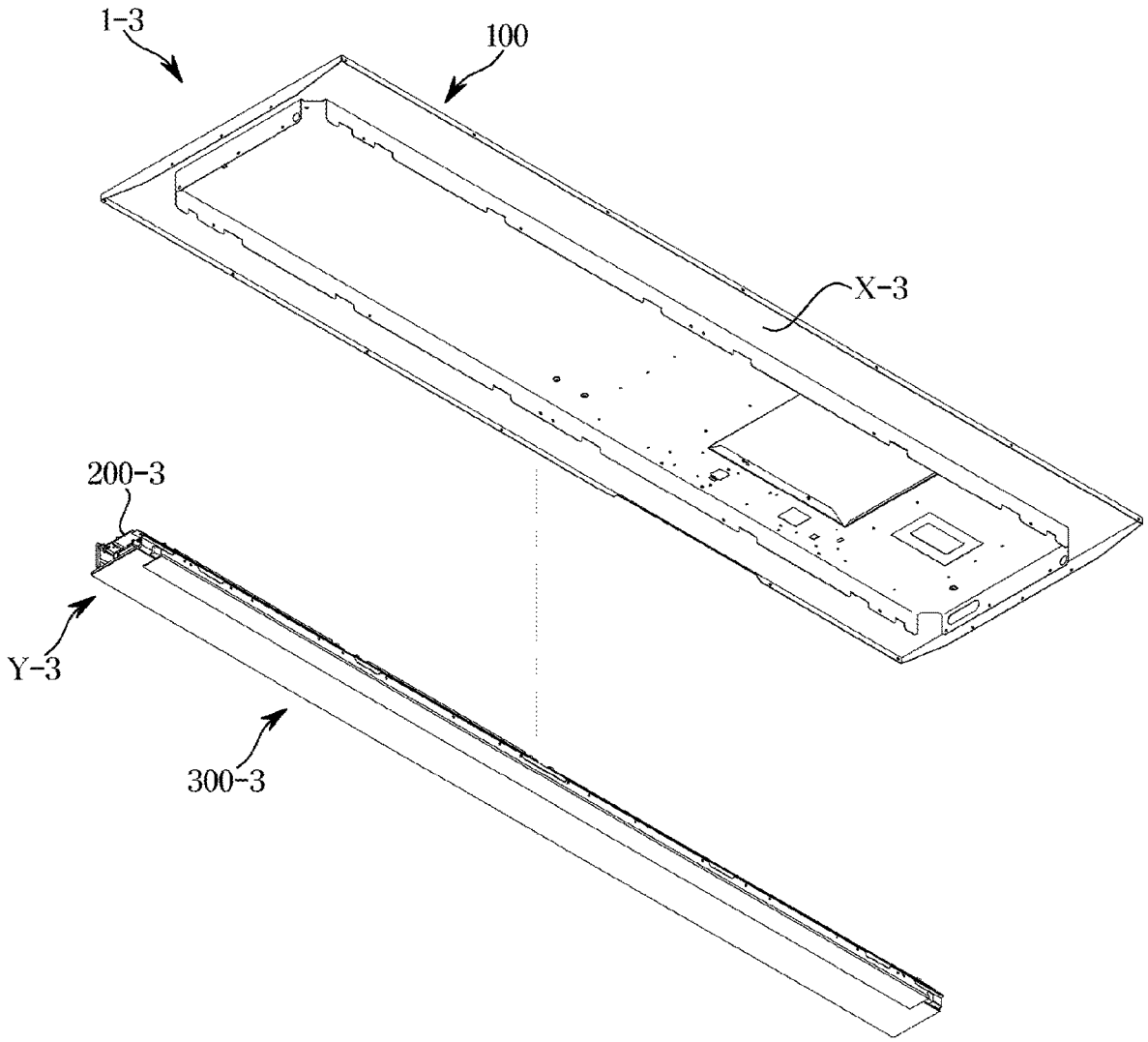
FIG. 22 is an exploded view showing a portion of a main body of a range hood according to an embodiment of the disclosure.

FIG. 22 is an exploded view showing a portion of a main body X-3 of a range hood 1-3 according to an embodiment of the disclosure.

Referring to FIG. 22, the range hood 1-3 according to an embodiment of the disclosure will be described.

The range hood 1-3 may include a light source device Y-3.

The light source device Y-3 may include a light source unit 200-3 and a light source module 300-3.

In FIG. 22, the light source unit 200-3 may be coupled to the light source module 300-3. That is, the light source unit 200-3 together with the light source module 300-3 may provide the light source device Y-3 which is coupled to the housing 100 by a respective coupling member. In contrast, with reference to FIG. 14, the module part housing 121 of the housing 100 may be coupled to the light source module 300 by a coupling member, while the light source unit 200 may be coupled to the housing plate 110 of the housing 100 by a coupling member.

According to an embodiment of the disclosure, the range hood 1 may irradiate light onto the cooktop 2 by including the light source module 300.

According to an embodiment of the disclosure, by including the illumination light source 210 capable of irradiating light in the first direction D1 toward the cooktop 2 and the guide light source 310 capable of irradiating light in the second direction D2 that intersects the first direction D1, light may be irradiated onto the outer appearance of the range hood 1, while being irradiated onto the cooktop 2.

According to an embodiment of the disclosure, by including the illumination light source 210 and the guide light source 310 that are controlled independently from each other, both in light emission and color of the emitted light, emission and color of the light may be irradiated onto the outer appearance of the range hood 1, independently from light being irradiated onto the cooktop 2.

According to an embodiment of the disclosure, by including the guide light source 310 for irradiating guide light toward the cooktop 2 and the guide diffuser as a light guide member for reflecting the guide light in another direction, light sources that irradiate light in different initial light path directions within a limited space may be positioned.

An embodiment of the disclosure is an aspect of the disclosure to provide a range hood configured to irradiate light onto a cooktop.

An embodiment of the disclosure is an aspect of the disclosure to provide a range hood configured to irradiate light to an outer appearance thereof while irradiating light onto a cooktop.

An embodiment of the disclosure is an aspect of the disclosure to provide a range hood capable of irradiating light to an outer appearance thereof, independently from light that is irradiated onto a cooktop.

An embodiment of the disclosure is an aspect of the disclosure to provide a range hood in which a plurality of light sources are positioned to irradiate light in different directions on a limited space.

According to an embodiment of the disclosure, a range hood for ventilating smell generated from a cooking material being cooked on a cooktop may include: an exhaust fan; a duct may be configured to accommodate the exhaust fan; and a main body may be coupled to the duct and facing the cooktop, wherein the main body may include a light source device including an illumination light source capable of emitting illumination light in a first direction toward the cooktop from the main body, and a guide light source capable of emitting guide light in a second direction from the main body.

The guide light source may be controlled independently from the illumination light source.

The second direction may intersect the first direction.

The guide light source may emit the guide light having a color that is different from a color of the illumination light emitted from the illumination light source.

The light source device may further include a transparent member spaced in the first direction from the illumination light source and configured to diffuse the illumination light.

The light source device may further include a light diffuser positioned between the transparent member and the illumination light source and configured to diffuse the illumination light, and the illumination light may pass through the light diffuser and the transparent member and be emitted toward the cooktop.

The light diffuser may be detachably supported by the transparent member.

The light source device may include: a bracket supporting unit positioned on the transparent member and positioned in the second direction from the light diffuser; and a light source supporting unit positioned on the transparent member and positioned in an opposite direction of the second direction from the light diffuser, wherein the light diffuser may include a diffuser plate guide portion bent in an opposite direction of the first direction to be in contact with the bracket supporting unit or the light source supporting unit.

The guide light source may emit the guide light in the first direction, and the light source device may further include a guide diffuser plate configured to reflect the guide light in the second direction.

The guide diffuser plate may face the transparent member such that the guide light is emitted by passing through the transparent member.

At least one portion of the guide diffuser plate may be spaced from the guide light source to define a guide diffusing space between the guide diffuser plate and the guide light source.

The light source device may further include a light source supporting unit positioned in the second direction from the guide light source such that the guide diffusing space is defined between the light source supporting unit and the guide diffuser plate, and the light source supporting unit may include an indirect reflection surface toward the guide diffusing space to reflect the guide light.

The guide diffuser plate may include a prism portion configured such that the guide light is transmitted through inside of the prism portion and reflected from an inclined surface inclined with respect to the first direction and the second direction.

The range hood may further include a guide light source substrate configured to support the guide light source, wherein the guide diffuser plate may include a substrate supporting portion configured to support the guide light source substrate.

The substrate supporting portion may be positioned to a side of the guide light source, and the guide diffuser plate may further include a connecting portion extending from the substrate supporting portion to the prism portion to guide the guide light emitted from the guide light source to the prism portion.

According to an embodiment of the disclosure, a range hood for ventilating bad smell generated from a cooking material being cooked on a cooktop may include a main body facing the cooktop, wherein the main body may include a light source device including an illumination light source capable of emitting illumination light in a first direction toward the cooktop from the main body and a guide light source capable of emitting guide light in a second direction from the main body, the light source device being detachable from the main body.

The range hood may further include a fine dust sensor configured to output a signal according to an amount of fine dust and a processor electrically connected with the fine dust sensor, wherein the processor may control a color of the guide light through the guide light source based on a signal output from the fine dust sensor which has measured fine dust that is greater than or equal to a preset value.

The light source device may further include a transparent member configured to define an illumination diffusing space through which the illumination light passes by being spaced in the first direction from the illumination light source to diffuse the illumination light, wherein the guide light source may be positioned in an opposite direction of the second direction from the transparent member, and emit guide light in the second direction toward the transparent member.

The light source device may further include an illumination guide diffuser plate spaced in the opposite direction of the second direction from the illumination light source, the illumination light source may be configured to emit the illumination light toward the illumination guide diffuser plate, and the illumination guide diffuser plate may reflect the illumination light emitted from the illumination light source in the first direction.

According to an embodiment of the disclosure, a range hood may include: an exhaust fan; a duct may be configured to accommodate the exhaust fan; an illumination light source may be configured to emit illumination light downward; a guide light source may be configured to emit guide light in a front direction; a transparent member may be spaced downward from the illumination light source; and an illumination diffuser plate may be positioned between the transparent member and the illumination light source and may be configured to diffuse the illumination light.

According to an embodiment of the disclosure, a ventilation hood comprising, a hood body which faces a cooktop in a first direction, the cooktop including a one side from which the hood body is viewed, a light source device within the hood body, the light source device emitting an illumination light in the first direction, to the cooktop, and emitting a guide light in a second direction, to the one side of the cooktop, and an exhaust duct which is connected to the hood body and from which air exits the ventilation hood.

The light source device comprises a guide light source which emits the guide light, and an illumination light source which emits the illumination light, and emission of the guide light by the guide light source is independent from emission of the illumination light by the illumination light source.

The second direction intersects the first direction.

A color of the guide light which is emitted to the one side of the cooktop is different from a color of the illumination light which is emitted to the cooktop.

The light source device comprises an illumination light source which emits the illumination light, and a transparent member facing the illumination light source and through which the illumination light passes in the first direction, to the cooktop.

The light source device further comprises a light diffuser which is between the transparent member and the illumination light source, and the illumination light passes in the first direction through both the transparent member and the light diffuser, to the cooktop.

The ventilation hood of claim 6, wherein the light diffuser is removably attached to the hood body.

The light source device further comprises a first sidewall which is extended along the light source device, is on the transparent member and is closer to the one side of the cooktop than the light diffuser, a second sidewall which is on the transparent member and faces the first sidewall with the light diffuser therebetween, a light diffusing space defined by the light diffuser together with the first sidewall and the second sidewall, and the illumination light passes in the first direction through the light diffusing space and both the transparent member and the light diffuser, to the cooktop.

The light source device further comprises a guide light source which emits the guide light in the first direction, and a light guide member which receives the guide light in the first direction from the guide light source and emits the guide light in the second direction, to the one side of the cooktop.

The light guide member faces the transparent member, and the guide light which is emitted by the light guide member passes through the transparent member, to the one side of the cooktop.

The light source device further comprises the guide light source spaced apart from the light guide member, and a guide diffusing space defined between the guide light source and the light guide member.

The light source device further comprises a sidewall between the guide light source and the illumination light source, along the second direction, and the guide diffusing space further defined with the sidewall.

The light guide member comprises an inclined surface, and the guide light which is emitted by the light guide source in the first direction transmits through the light guide member and is reflected at the inclined surface of the light guide member, to be emitted by the light guide member in the second direction, to the one side of the cooktop.

The light source device further comprises a guide light source substrate from which the guide light source protrudes and the light guide member including a substrate supporting portion on which the guide light source substrate is supported.

The light source device further includes the substrate supporting portion adjacent to the guide light source along the second direction, and the light guide member further comprising a connecting portion which connects the substrate supporting portion to the inclined surface and guides the guide light from the guide light source to the inclined surface.

The light source device comprises a guide light source which emits the guide light in the first direction, an illumination light source which emits the illumination light in the first direction, and a light guide member which receives the guide light in the first direction from the guide light source and emits the guide light in the second direction, to a front side of the cooktop.

The light source device comprises an illumination light source which emits the illumination light in the first direction, a transparent member facing the illumination light source and through which the illumination light passes in the first direction, to the cooktop, the transparent member having a light incident end surface, and a guide light source which emits the guide light in the second direction and is spaced apart from the light incident surface of the transparent member in a direction opposite to the second direction.

The light source device comprises a guide light source which emits the guide light in the first direction, an illumination light source which emits the illumination light in a direction inclined with respect to the first direction, and a light guide member which receives the guide light and the illumination light, and emits the guide light in the second direction to the front side of the cooktop and emits the illumination light in the first direction to the cooktop, respectively.

The hood body comprises a housing plate facing the cooktop in the first direction and having an outer edge, and a frame portion which protrudes in the first direction from the housing plate and extends along the outer edge of the housing plate, the frame portion being spaced apart from the outer edge of the housing plate, and the light source device is connected to the frame portion and extends from the frame portion to the outer edge of the housing plate, at the front side of the cooktop.

The light source device comprises a guide light source which emits the guide light, an illumination light source which emits the illumination light, and the guide light source is further from the front side of the cooktop than the illumination light source, along the second direction.

Referring to FIG. 15, for example, the light source device Y includes a guide light source 310 which emits the guide light L2 in the first direction D1, an illumination light source 210 which emits the illumination light L1 in the first direction D1, and a light guide member which receives the guide light L2 in the first direction D1 from the guide light source 310 and emits the guide light L2 in the second direction D2, to the front side of the cooktop 2.

Referring to FIG. 20, for example, the light source device Y includes an illumination light source 210 which emits the illumination light L1 in the first direction D1, a transparent member 350 facing the illumination light source 210 and through which the illumination light L1 passes in the first direction D1, to the cooktop 2, the transparent member 350 having a light incident end surface (e.g., the right end closest to the guide light source 310-1), and a guide light source 310-1 which emits the guide light L2 in the second direction and is spaced apart from the light incident surface of the transparent member 350 in a direction opposite to the second direction D2.

Referring to FIG. 21, for example, the light source device Y includes a guide light source 310 which emits the guide light L2 in the first direction D1, an illumination light source 210 which emits the illumination light L1 in a direction inclined with respect to the first direction D1 (e.g., the direction opposite to the second direction D2 is inclined relative to the first direction D1), and a light guide member (e.g., the guide diffuser 370 together with the illumination guide diffuser 250-2) which receives the guide light L2 and the illumination light, and emits the guide light in the second direction to the front side of the cooktop and emits the illumination light in the first direction to the cooktop, respectively.

Referring to FIGS. 1, 2, 6, 15, 20 and 21, for example, the hood body includes a housing plate 110 facing the cooktop 2 in the first direction D1 and having an outer edge, and a frame portion (e.g., part housing 120) which protrudes in the first direction D1 from the housing plate 110 and extends along the outer edge of the housing plate 110, the frame portion being spaced apart from the outer edge of the housing plate 110. The light source device Y is connected to the frame portion and extends from the frame portion to the outer edge of the housing plate 110, at the front side of the cooktop 2.

Referring to FIGS. 15, 20 and 21, for example, the light source device Y includes a guide light source 310 which emits the guide light L2, an illumination light source 210 which emits the illumination light L1, and the guide light source 310 being further from the front side of the cooktop 2 than the illumination light source 210, along the second direction D2.

However, effects that may be achieved by the disclosure are not limited to the above-mentioned effects, and other effects not mentioned will be clearly understood by one of ordinary skill in the technical field to which the disclosure belongs from the following descriptions.

Although specific embodiments of the disclosure have been described, the disclosure is not limited to the above-described specific embodiments, and it is obvious that various modifications can be made by persons of ordinary skill in the technical art to which the disclosure belongs without deviating from the gist of the disclosure set forth in the claims, and the modifications surely reside in the scope of the claims.

Although a few embodiments of the disclosure have been shown and described, it would be appreciated by those skilled in the art that changes may be made in these embodiments without departing from the principles and spirit of the disclosure, the scope of which is defined in the claims and their equivalents.

What is claimed is:

1. A range hood comprising:

a duct; and a main body coupled to the duct and facing a cooktop including a front side, wherein the main body includes a light source device including:

an illumination light source capable of emitting illumination light in a first direction toward the cooktop from the main body, and a guide light source which is further from the front side than the illumination light source and capable of emitting guide light in a second direction toward the front side of the cooktop.

2. The range hood of claim 1, wherein the emission of the guide light by the guide light source is independent from emission of the illumination light by the illumination light source.

3. The range hood of claim 1, wherein a color of the guide light emitted from the guide light source is different from a color of the illumination light emitted from the illumination light source.

4. The range hood of claim 1, wherein the light source device further comprises a transparent member spaced in the first direction from the illumination light source such that the illumination light is diffusable.

5. The range hood of claim 4, wherein the light source device further comprises a light diffuser positioned between the transparent member and the illumination light source such that the illumination light is diffusable, and the illumination light is emitted toward the cooktop by passing through the light diffuser and the transparent member.

6. The range hood of claim 5, wherein the light diffuser is supported by the transparent member such that the light diffuser is detachable from the range hood.

7. The range hood of claim 5, wherein the light source device further comprises:

a bracket supporting unit positioned on the transparent member and positioned in the second direction from the light diffuser; and a light source supporting unit positioned on the transparent member and positioned in an opposite direction of the second direction from the light diffuser, and the light diffuser comprises a diffuser plate guide portion bent in an opposite direction of the first direction to be in contact with the bracket supporting unit or the light source supporting unit.

8. The range hood of claim 4, wherein the guide light source emits the guide light in the first direction, and the light source device further comprises a guide diffuser configured to reflect the guide light in the second direction.

9. The range hood of claim 8, wherein the guide diffuser faces the transparent member such that the guide light is emitted by passing through the transparent member.

10. The range hood of claim 8, wherein at least one portion of the guide diffuser is spaced from the guide light source to define a guide diffusing space between the guide diffuser and the guide light source.

11. The range hood of claim 10, wherein the light source device further comprises a light source supporting unit positioned in the second direction from the guide light source such that the guide diffusing space is defined between the light source supporting unit and the guide diffuser, and the light source supporting unit has an indirect reflection surface facing the guide diffusing space to reflect the guide light.

12. The range hood of claim 10, wherein the guide diffuser comprises a prism portion configured such that the guide light is transmitted through inside of the prism portion and reflected from an inclined surface of the prism portion which is inclined with respect to the first direction and the second direction.

13. The range hood of claim 12, further comprising a guide light source substrate configured to support the guide light source, wherein the guide diffuser includes a substrate supporting portion configured to support the guide light source substrate.

14. The range hood of claim 13, wherein the substrate supporting portion is positioned to a side of the guide light source, and the guide diffuser further comprises a connecting portion extending from the substrate supporting portion to the prism portion such that the guide diffuser guides the guide light emitted from the guide light source to the prism portion.

15. A range hood comprising:

a hood body which faces a cooktop in a first direction, the cooktop including a front side viewable from outside the hood body;

a light source device within the hood body, the light source device emitting an illumination light in the first direction, to the cooktop, and emitting a guide light in a second direction, to the front side of the cooktop; and an exhaust duct which is connected to the hood body and from which air exits the range hood.

16. The range hood of claim 15, wherein the light source device comprises:

a guide light source which emits the guide light in the first direction, an illumination light source which emits the illumination light in the first direction, and a light guide member which receives the guide light in the first direction from the guide light source and emits the guide light in the second direction, to the front side of the cooktop.

17. The range hood of claim 15, wherein the light source device comprises:

an illumination light source which emits the illumination light in the first direction, a transparent member facing the illumination light source and through which the illumination light passes in the first direction, to the cooktop, the transparent member having a light incident end surface, and a guide light source which emits the guide light in the second direction and is spaced apart from the light incident surface of the transparent member in a direction opposite to the second direction.

18. The range hood of claim 15, wherein the light source device comprises:

a guide light source which emits the guide light in the first direction, an illumination light source which emits the illumination light in a direction inclined with respect to the first direction, and a light guide member which receives the guide light and the illumination light, and emits the guide light in the second direction to the front side of the cooktop and emits the illumination light in the first direction to the cooktop, respectively.

19. The range hood of claim 15, wherein the hood body comprises:

a housing plate facing the cooktop in the first direction and having an outer edge, and a frame portion which protrudes in the first direction from the housing plate and extends along the outer edge of the housing plate, the frame portion being spaced apart from the outer edge of the housing plate, and the light source device is connected to the frame portion and extends from the frame portion to the outer edge of the housing plate, at the front side of the cooktop.

* * * * *